US010758939B2

(12) United States Patent
Hasegawa et al.

(10) Patent No.: US 10,758,939 B2
(45) Date of Patent: Sep. 1, 2020

(54) VIBRATION PRESENTATION APPARATUS AND METHOD FOR USING THE SAME

(71) Applicant: TOKYO INSTITUTE OF TECHNOLOGY, Tokyo (JP)

(72) Inventors: Shoichi Hasegawa, Tokyo (JP); Yusuke Yamazaki, Tokyo (JP)

(73) Assignee: TOKYO INSTITUTE OF TECHNOLOGY, Tokyo (JP)

( * ) Notice: Subject to any disclaimer, the term of this patent is extended or adjusted under 35 U.S.C. 154(b) by 425 days.

(21) Appl. No.: 15/755,637

(22) PCT Filed: Aug. 9, 2016

(86) PCT No.: PCT/JP2016/073420

§ 371 (c)(1),
(2) Date: Feb. 27, 2018

(87) PCT Pub. No.: WO2017/038405

PCT Pub. Date: Mar. 9, 2017

(65) Prior Publication Data

US 2020/0230651 A1 Jul. 23, 2020

(30) Foreign Application Priority Data

Aug. 31, 2015 (JP) ..... 2015-170224

(51) Int. Cl.
*B06B 1/16* (2006.01)
*G08B 6/00* (2006.01)

(52) U.S. Cl.
CPC . *B06B 1/16* (2013.01); *G08B 6/00* (2013.01)

(58) Field of Classification Search
CPC ..... G08B 6/00; H02K 35/02; H04R 15/00; H04R 1/00; H04R 2460/13; H04R 3/12; B06B 1/16
See application file for complete search history.

(56) References Cited

U.S. PATENT DOCUMENTS 6,970,275 B2 * 11/2005 Cannon ..... G02B 26/0833 359/213.1
2011/0204653 A1 * 8/2011 Liu ..... F03G 5/06 290/1 R
2013/0214913 A1 8/2013 Efrati

FOREIGN PATENT DOCUMENTS

JP 59-67074 5/1984
JP 2-138990 11/1990
(Continued)

OTHER PUBLICATIONS

International Search Report (ISR) dated Oct. 25, 2016 in International (PCT) Application No. PCT/JP2016/073420.

*Primary Examiner* — Omeed Alizada
(74) *Attorney, Agent, or Firm* — Wenderoth, Lind & Ponack, L.L.P.

(57) ABSTRACT

A wearable vibration presentation apparatus includes a weight saving and simplified electric-mechanical vibration converter that has a mechanism that is quite different. The vibration presentation apparatus includes a transmitting member and a control unit, wherein a side portion of the transmitting member abuts a portion of a vibration presentation object or is wound to the vibration presentation object. Vibration is transmitted to the vibration presentation object via the transmitting member by applying predetermined tension to the transmitting member and varying the predetermined tension based on a driving signal on a basis of a vibration presentation signal.

32 Claims, 14 Drawing Sheets

(56) References Cited

FOREIGN PATENT DOCUMENTS

| | | |
|---|---|---|
| JP | 7-323068 | 12/1995 |
| JP | 8-116581 | 5/1996 |
| JP | 2001-212198 | 8/2001 |
| JP | 2011-71831 | 4/2011 |
| JP | 2013-541264 | 11/2013 |
| JP | 2014-124547 | 7/2014 |

* cited by examiner

VIBRATION PRESENTATION APPARATUS AND METHOD FOR USING THE SAME

TECHNICAL FIELD

The present invention relates to a wearable vibration presentation apparatus by utilizing a transmitting member such as a thread and a driving mechanism such as a motor, and in particular to the vibration presentation apparatus to transmit the vibration to a body of a user, and a method for using the vibration presentation apparatus. For example, a bobbin that the thread is wound is attached to the motor, constant tension is retained by motive power of the motor or the like after winding the thread around the body of the user, and then the vibration is generated by varying the tension by means of the motor or the like.

BACKGROUND ART

When listening to music, watching movies and the like, generally, speakers and the like are used to reproduce acoustic information. Although such the speakers can reproduce the acoustic information with audible frequencies, the large size speakers are required in order to efficiently reproduce (air vibration) sound with a low frequency range whose frequency is in a range of 20 [Hz] to 200 [Hz].

On the other hand, not only auditory sense but also somatic sense of a whole body can be contributed in perception of the sound in the low frequency range. Particularly, it is said that a sense of presence is high by using the auditory sense in combination with the somatic sense in listening to music by using headphones or the like.

Thus, recently, a system that utilizes body sensible acoustic which alternates the presentation of the acoustic signal with the conventional auditory sense stimulation and presents the acoustic signal via the somatic sense, or presents the acoustic signal with the combination of the auditory sense stimulation and the somatic sense.

In the system that utilizes the above somatic sense, for example, there exists the system that enhances the sense of presence to the music by feeling the sound, the low frequency components of the music and the like as the acoustic vibration to the user by means of bone vibration and the vibration to a body trunk or the body.

In the above body sensible acoustic system, for example, instead of generating the sound by vibrating the air, a converter that converts the electric signal into the mechanical vibration such as an electric-mechanical vibration converter which is disclosed in Japanese Unexamined Patent Publication No. H07-323068 A (Patent Document 1), is used.

In a technology described in the above Patent Document 1, as shown in a side cross-sectional view of FIG. 14A, an elastic member having rigidity that is withstood to the load of the weight of the human body is used as a casing 2 of the electric-mechanical vibration converter 1. In this casing 2, a magnetic circuit 6 that comprises a yoke 4 and a magnet 5 is loosely fitted via a damper 3. A support 8 of a coil 7 that is faced on a magnetic space of the yoke 4 is attached to the casing 2. The electric signal that is inputted into the coil 7 is converted into the mechanical motion by magnetic action, and then the casing 2 vibrates.

As examples that such the converters are used, a relaxation chair disclosed in Japanese Unexamined Patent Publication No. 2001-212198 A (Patent Document 2) that transmits the vibration to the user who sits thereon, an attachable body sensible vibration apparatus disclosed in Japanese Unexamined Patent Publication No. H08-116581 A (Patent Document 3) and the like are known.

Here, in the above Patent Document 2, as shown in a perspective view of FIG. 14B, the relaxation chair 11 that comprises plural vibration members 10 which convert the acoustic signal into the vibration sound for relaxation is described. In the above Patent Document 3, as shown in a perspective view of FIG. 14C, the attachable body sensible vibration apparatus 12 is described. Shoulder pads 14 are connected to a waist pad 13 via length adjustable belts, a waist belt 15 is provided with the waist pad 13 and is formed with a harness type to fix the human body to the waist pad 13, and the electric-mechanical vibration converters 16, which generate the vibration generally consistent with waveforms of the voice signal against the voice signal electric-converted the voice with the audible range, are attached to the shoulder pads 14 and the waist pad 13.

THE LIST OF PRIOR ART DOCUMENTS

Patent Documents

Patent Document 1: Japanese Unexamined Patent Publication No. H07-323068 A

Patent Document 2: Japanese Unexamined Patent Publication No. 2001-212198 A

Patent Document 3: Japanese Unexamined Patent Publication No. H08-116581 A

SUMMARY OF THE INVENTION

Problems to be Solved by the Invention

The converter that is disclosed in the above Patent Document 1 and converts the electric signal into the mechanical vibration is generally a voice coil (or a transducer) and the like. The above voice coil has a basic structure similar to the speaker in which the magnet and the coil are used. Since the large size voice coil is required in order to efficiently convert the sound with the low frequency range into the mechanical vibration (the acoustic vibration), there is a problem that the weight inevitably increases and it is hard to realize a miniaturization and a weight reduction.

Consequently, the main using method is to utilize as the casing such as large size and heavy furniture such as the chair, as described in the above Patent Document 2. Since these applied products are large, there is a problem that a place and a situation which the products can use are limited.

In addition, in a case of the vibration presentation apparatus such as the above chair on which the electric-mechanical vibration converter is disposed, in principle, a degree of freedom such as posture and action of the user is largely limited. If the user sits on the chair and the body of the user presses the chair, the user can feel the above acoustic vibration. Then, when the user moves from the chair, there is a problem that the sense of presence due to the vibration presentation is lost.

In the technology described in the above Patent Document 3, as described above, it is disclosed that the attachable body sensitive vibration apparatus formed with the harness type to which the above electric-mechanical vibration converter is attached presents the vibration to the user.

Since the technology described in the above Patent Document 3 has a configuration that the user uses the body sensible vibration apparatus attachable, the degree of freedom such as the posture and the action of the user is improved against the technology described in the above Patent Document 2.

However, in the technology described in the above Patent Document 3, as described above, it is necessary for the user to attach the heavy electric-mechanical vibration converter. Since the range that the acoustic vibration can be transmitted by the above electric-mechanical vibration converter is around the above electric-mechanical vibration converter, in order to present the effective acoustic vibration to the user, it is necessary for the user to attach the plural electric-mechanical vibration converters. There is a problem that the load to the user increases.

Accordingly, the present invention is intended to resolve the above problems, and an object of the present invention is to provide the wearable vibration presentation apparatus by using the weight saving and simplified electric-mechanical vibration converter that has the quite different mechanism from the conventional one, and the method for using the vibration presentation apparatus.

Means for Solving the Problems

In order to resolve the above problems, the present invention provides to a vibration presentation apparatus comprising a transmitting member and a control unit, wherein a side portion of the transmitting member is abutted to a portion of a vibration presentation object or is wound to the vibration presentation object, and vibration is transmitted to the vibration presentation object via the transmitting member by applying predetermined tension to the transmitting member and varying the predetermined tension based on a driving signal on a basis of a vibration presentation signal.

The resolution of the above-described problems is efficiently achieved by that: wherein the transmitting member comprises a first holder connected to one end of the transmitting member and a second holder connected to the other end of the transmitting member, a first driving mechanism that applies the tension to the transmitting member is provided with the first holder, the driving signal on a basis of the vibration presentation signal is inputted into the first driving mechanism, by driving the first driving mechanism, the predetermined tension is applied to the transmitting member, and the predetermined tension is varied based on the driving signal; or wherein the first driving mechanism includes at least two sub-driving mechanisms; or wherein one of the at least two sub-driving mechanisms generates the predetermined tension to the transmitting member and the others of the at least two sub-driving mechanisms vary the predetermined tension based on the driving signal.

The resolution of the above-described problems is efficiently achieved by that: wherein the first driving mechanism comprises a first bobbin and a first electric motor connected to the first bobbin, one end of the transmitting member is connected to the first bobbin, by driving the first electric motor and winding or rewinding one end of the transmitting member on the first bobbin, one end of the transmitting member is towed and the predetermined tension is generated to the transmitting member, and the vibration is transmitted to the vibration presentation object via the transmitting member by varying the predetermined tension based on the driving signal; or wherein a second driving mechanism that applies the tension to the transmitting member is provided with the second holder, the driving signal on a basis of the vibration presentation signal is inputted into the first driving mechanism and the second driving mechanism, by cooperatively driving the first driving mechanism and the second driving mechanism, the predetermined tension is applied to the transmitting member, and the vibration is transmitted to the vibration presentation object via the transmitting member by varying the predetermined tension based on the driving signal; or wherein the second driving mechanism includes at least two sub-driving mechanisms; or wherein one of the at least two sub-driving mechanisms generates the predetermined tension to the transmitting member, and the others of the at least two sub-driving mechanisms vary the predetermined tension based on the driving signal; or wherein the second driving mechanism comprises a second bobbin and a second electric motor connected to the second bobbin, the other end of the transmitting member is connected to the second bobbin, the driving signal on a basis of the vibration presentation signal is inputted into the first electric motor and the second electric motor, by cooperatively driving the first electric motor and the second electric motor and winding or rewinding one end and the other end of the transmitting member on the first bobbin and the second bobbin respectively, the transmitting member is towed by means of the predetermined tension, and the vibration is transmitted to the vibration presentation object via the transmitting member by varying the predetermined tension based on the driving signal; or wherein the driving mechanism comprises a driving component such as a motor, a flat spiral spring, a voice coil, a speaker, a spring, a coil spring, a piezoelectric material and an electrically conductive polymer actuator or a combination thereof, and a motive power transmitting component such as a bobbin, a pulley, a gear and a worm gear or a combination thereof; or wherein the transmitting member comprises a material having a line-shape, a belt-shape or a net-shape, or a combination material thereof; or wherein the transmitting member comprises connection sections that are disposed at inward positions from one end and the other end of the transmitting member, and the connection sections connect or disconnect the transmitting member by means of connection members that constitute the connection sections; or wherein the connection members comprise a hook that is disposed near one end of the transmitting member, and a ring that is disposed near the other end of the transmitting member and is engaged with the hook, or wherein the transmitting member comprises a draw-in mechanism that the both ends of the transmitting member are drawn inwardly, and the draw-in mechanism, which alternates the driving mechanism or cooperates with the driving mechanism, generates the predetermined tension to the transmitting member by winding the transmitting member to an inside of the draw-in mechanism; or wherein the first holder is connected to the second holder each other.

In order to resolve the above problems, the present invention is provided to the vibration presentation apparatus wherein the transmitting member comprises a single holder to hold the both ends of the transmitting member, a driving mechanism that applies the tension to the transmitting member is provided with the holder, a driving signal on a basis of a vibration presentation signal is inputted into the driving mechanism, by driving the driving mechanism, the predetermined tension is applied to the transmitting member, and the vibration is transmitted to the vibration presentation object via the transmitting member by varying the predetermined tension based on the driving signal.

The resolution of the above-described problems is efficiently achieved by that: wherein the driving mechanism includes at least two sub-driving mechanisms; or wherein one of the at least two sub-driving mechanisms generates the predetermined tension to the transmitting member and the others of the at least two sub-driving mechanisms vary the predetermined tension based on the driving signal; or wherein the driving mechanism comprises a driving component such as a motor, a flat spiral spring, a voice coil, a speaker, a spring, a coil spring, a piezoelectric material and an electrically conductive polymer actuator or a combination thereof, and a motive power transmitting component such as a bobbin, a pulley, a gear and a worm gear or a combination thereof.

The resolution of the above-described problems is efficiently achieved by that: wherein the driving mechanism comprises two bobbins and an electric motor, the two bobbins are connected to a rotational shaft of the electric motor, one end and the other end of the transmitting member are connected to the two bobbins from different directions to wind or rewind the transmitting member by means of a rotation of the electric motor, a driving signal on a basis of a vibration presentation signal is inputted into the electric motor, by driving the electric motor and winding or rewinding one end and the other end of the transmitting member on the two bobbins, the transmitting member is towed by means of the predetermined tension, and the vibration is transmitted to the vibration presentation object via the transmitting member by varying the predetermined tension based on the driving signal; or wherein the transmitting member comprises a material having a line-shape, a belt-shape ora net-shape, ora combination material thereof; or wherein the transmitting member comprises connection sections that are disposed at inward positions from one end and the other end of the transmitting member, and the connection sections connect or disconnect the transmitting member by means of connection members that constitute the connection sections, or wherein the connection members comprise a hook that is disposed near one end of the transmitting member, and a ring that is disposed near the other end of the transmitting member and is engaged with the hook; or wherein the transmitting member comprises a draw-in mechanism that the both ends of the transmitting member are drawn inwardly, and the draw-in mechanism, which alternates the driving mechanism or cooperates with the driving mechanism, generates the predetermined tension to the transmitting member by winding the transmitting member to an inside of the draw-in mechanism.

In order to resolve the above problems, the present invention is provided to the method for using the vibration presentation apparatus comprising the first holder and the second holder that the vibration presentation object is a user, comprising steps of: coiling at least one turn of the transmitting member around a portion of the user body with clothes on; connecting the first holder to the second holder at any positon of a portion of the user body; and driving the vibration presentation apparatus after the connecting, wherein the user feels the vibration based on the vibration presentation signal.

The resolution of the above-described problems is efficiently achieved by that: wherein the portion of the user body is a breast, a waist, a shoulder or a diagonal portion from a shoulder to a waist, or a combination thereof; or wherein a position that is connected the first holder to the second holder is a front side of the user.

In order to resolve the above problems, the present invention is provided to the method for using the vibration presentation apparatus comprising the transmitting member or the transmitting member and a holder disposed at one end and the other end of the transmitting member that the vibration presentation object is a user, comprising steps of: coiling at least one turn of the transmitting member around a portion of the user body with clothes on; and driving the vibration presentation apparatus after the coiling, wherein the user feels the vibration based on the vibration presentation signal.

Effects of the Invention

According to the vibration presentation apparatus of the present invention that has the above configuration, it is possible to present the vibration to the vibration presentation object by using the transmitting member such as the thread, or by using the transmitting member such as the thread and the driving mechanism such as the motor. Thus, the presentation of the vibration by using the weight saving and compact apparatus against the conventional electric-mechanical vibration converter, is possible. Further, the vibration can be propagated to the wide range by using the transmitting member such as the above thread.

Furthermore, in the vibration presentation apparatus of the present invention, it is possible to adopt the method that the vibration is transmitted to the vibration presentation object such as the user by using the tension of the transmitting member such as the above thread. Consequently, to provide the weight saving and compact wearable vibration presentation apparatus, is possible. In a case that the transmitting member such as the above thread is coiled around the breast or the like of the above user, the vibration is transmitted to the wide range around the breast or the like of the above user. Then, it is possible to present the user via the portion around the above breast or the like with feeling as well as the listening to music in the hall or the like.

BRIEF DESCRIPTION OF THE DRAWINGS

In the accompanying drawings:

FIG. 1A is a perspective view showing a schematic appearance configuration of the present invention, and FIG. 1B is a perspective view showing a using example of the present invention;

FIG. 3A is a top view in a case that the transmitting member is not wound around a vibration presentation object and is abutted to the vibration presentation object, FIG. 3B is a top view in a case that the transmitting member is wound around the vibration presentation object and a first holder is connected to a second holder, and FIG. 3C is a top view in a case that the transmitting member is completely wound one turn around the vibration presentation object and the first holder is connected to the second holder;

FIG. 4A is a perspective view partially including a transparent view, FIG. 4B is a perspective view showing a configuration example of a motor portion, and FIG. 4C and FIG. 4D are side views showing a relationship among the motor, a bobbin and a line-shape member;

FIG. 6A is a top view, and FIG. 6B is a side view;

FIG. 9A is a perspective view, FIG. 9B is a side view in a case that two bobbin covers which constitute the driving mechanism of the above configuration example are removed, and connection sections are disconnected, and FIG. 9C is a top view showing a concept of a status when the above transmitting member is connected to the two bobbins which are connected to a rotational shaft of the electric motor provided with the above holder;

FIG. 11A is a plan view showing the outline of the configuration of the apparatus 1100 according to the embodiment in a case that the transmitting member is formed with a belt-shape, FIG. 11B is a perspective view showing an example that the belt illustrated in FIG. 11A is coiled one turn via a belt adjuster, and FIG. 11C is a plan view showing an example that the transmitting members are intermittently disposed in a base material of the belt and are electrically connected each other, being different from FIG. 11A and FIG. 11B;

FIG. 13A is a plan view showing the outline of the configuration in a case that the transmitting member is wound in a draw-in mechanism, and FIG. 13B is a perspective view showing a state that the transmitting member is rewound from the draw-in mechanism shown in FIG. 13A and the two holders are connected; FIG. 14A is a side cross-sectional view showing a conventional example of an electric-mechanical vibration converter, FIG. 14B is a perspective view exemplifying a case that the electric-mechanical vibration converter is used to a chair, and FIG. 14C is a perspective view showing an configuration example that the electric-mechanical vibration converter is attachable.

MODE FOR CARRYING OUT THE INVENTION

Figure 1A:
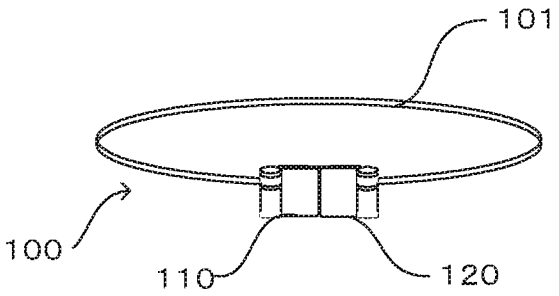
FIG. 1A and FIG. 1B show an embodiment of the present invention.

An embodiment according to the present invention will be described with reference to the drawings. In the above drawings, components, which have the same or similar structure, or the same or similar function, can be assigned to the same or similar symbols or reference numerals. In common components and elements, a part of indication and description can be omitted. An indication in a size or ratio of the respective components or between the respective components can be different from an actual size or ratio.

At first, an outline of a configuration of an embodiment according to the present invention and a principle of vibration presentation of the present invention will be described with reference to FIG. 1A to FIG. 3C.

Figure 1B:
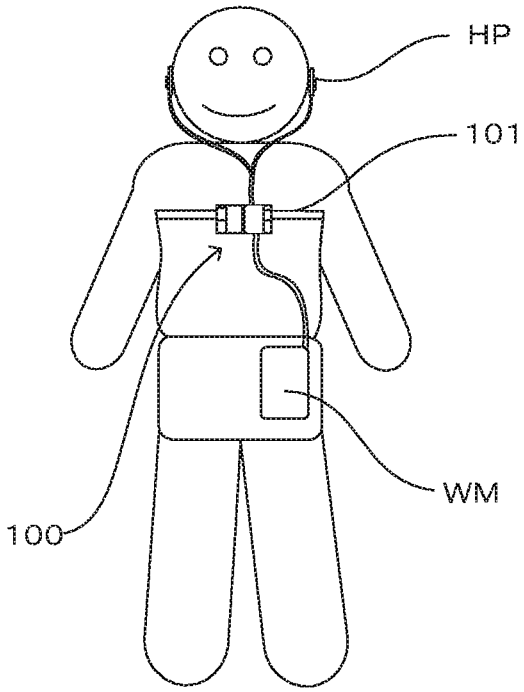

FIG. 1A and FIG. 1B show the embodiment of the present invention, FIG. 1A is a perspective view showing a schematic appearance configuration of the vibration presentation apparatus 100 according to the embodiment of the present invention, and FIG. 1B is a perspective view showing a using example of the vibration presentation apparatus 100 according to the above embodiment of the present invention.

The vibration presentation apparatus 100 according to the above embodiment of the present invention, whose outline is shown in FIG. 1A and FIG. 1B, comprises a transmitting member 101 that is constituted by a thread having a low stretching rate, a first holder 110 connected to one end of the transmitting member 101, and a second holder 120 connected to the other end of the transmitting member 101. Here, both the first holder 110 and the second holder 120 have a connection section, and in FIG. 1A and FIG. 1B, and by using the connection sections, the first holder 110 and the second holder 120 are connected.

As described below in detail, the above first holder 110 and the above second holder 120 comprise an electric motor and a bobbin serving as a driving mechanism, a control unit, a battery, input connectors that input an acoustic signal and the like as a vibration presentation signal from an external, and the like. The transmitting member 101 such as the above thread can be wound or rewound on the bobbin that the above driving mechanism comprises by using the above electric motor or the like.

Here, the above winding means that the above transmitting member is wound on a shaft of the bobbin by means of a rotation of the above electric motor or the like. The above rewinding means that the rotation, the torque, or the like of the above electric motor is loosen, and the transmitting member which is wound on the bobbin is operated to pull out from the bobbin.

In the present invention, for example, a constant tension is maintained by towing the above transmitting member 101 by means of the driving mechanism such as the above two electric motors. By applying a modulation corresponding to an acoustic signal and the like to the tension, the vibration of the acoustic vibration and the like is presented to the user or like who is a vibration presentation object.

That is, as shown in FIG. 1B, for example, at first, the user of the present apparatus winds one turn of the transmitting member 101 of the vibration presentation apparatus 100 around a breast and the like of the above user with clothes on, and the first holder 110 and the second holder 120 are connected at a front side or the like of the above user.

After the above two holders 110 and 120 are connected, the transmitting member 101 is retained by means of the constant tension around the breast and the like of the above user by driving the vibration presentation apparatus 100. Thereafter, the vibration presentation signal such as the acoustic signal S from a portable music reproducing apparatus WM and the like that the above user attach, is inputted into the vibration presentation apparatus 100.

The vibration presentation signal such as the acoustic signal S that is inputted from the above portable music reproducing apparatus WM is converted into the driving force such as the electric motors, which are equipped with the holders 110 and 120, by means of the control unit of the present apparatus 100, and is transmitted to the transmitted member. The winding and the rewinding of the transmitting member 101 that is wound around the breast and the like of the above user are performed. This is transmitted to the above user as a variation of the tension around the breast and the like of the above user, and it is possible for the user to feel the variation of the above tension as the variation of the acoustic vibration and the like.

Therefore, the above user can listen the music and the like by auditory sense through headphones HP from the above portable music reproducing apparatus WM and the like, and enables to feel the above music and the like as the vibration of the acoustic vibration and the like through the transmitting member 101 of the above vibration presentation apparatus 100.

Figure 2:
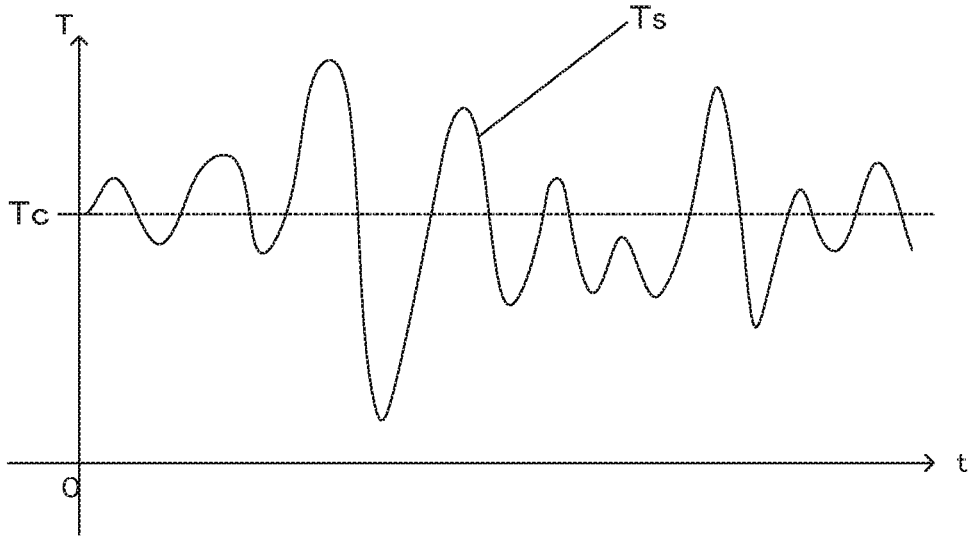
FIG. 2 is a graph showing a relationship between tension variation of a transmitting member and a time.

The vibration presentation due to the above tension variation is performed based on the principle that is described in, for example, FIG. 2, FIG. 3 and the following explanation.

Figure 3A:
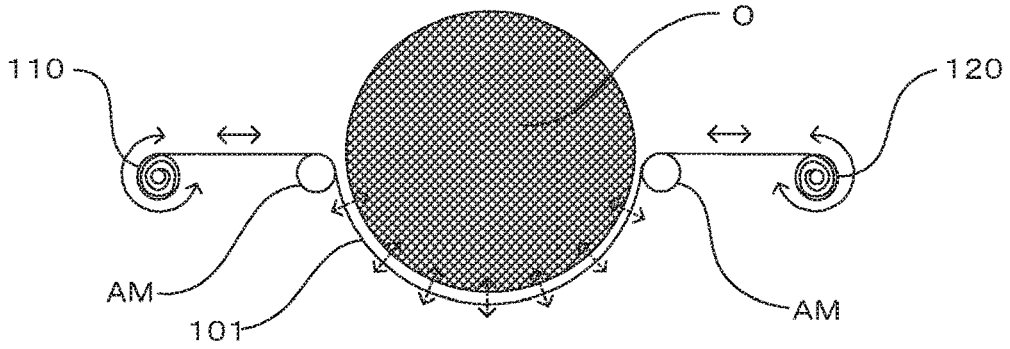
FIG. 3A, FIG. 3B and FIG. 3C schematically show an outline of a principle of vibration presentation according to the present invention.
Figure 3B:
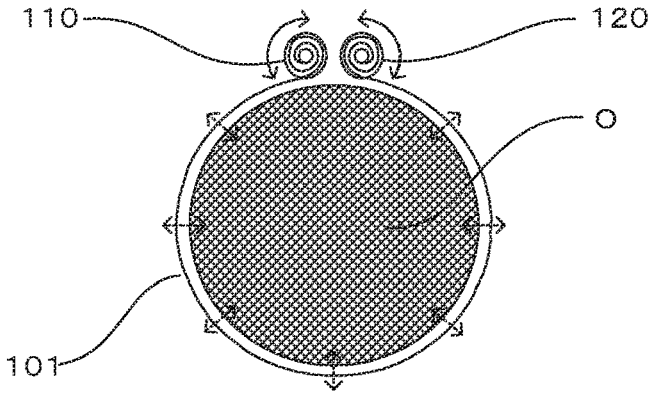
Figure 3C:
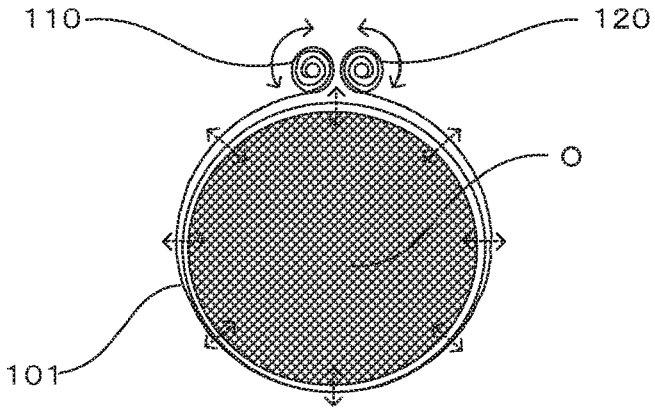

Here, the above FIG. 2 is a graph showing time variation of the tension and the modulation of the transmitting member by means of the vibration presentation apparatus of the present invention. FIG. 3A, FIG. 3B and FIG. 3C schematically show an outline of a principle of the vibration presentation according to the present invention, FIG. 3A is a top view in a case that the transmitting member 101 is not wound around the vibration presentation object O and is abutted to the vibration presentation object O, FIG. 3B is a top view in a case that the transmitting member 101 is wound around the vibration presentation object O and the first holder is connected to the second holder, and FIG. 3C is a top view in a case that the transmitting member 101 is completely wound one turn around the vibration presentation object O and the first holder is connected to the second holder. (As described below, in a case of adopting the embodiment that is constituted by using the single holder in the present invention, this case is corresponding to the configuration that the above two holder are connected in the above FIG. 3B and FIG. 3C.) In the configuration of the apparatus 100, as described above, the tension applied to the above transmitting member 101 can be varied by towing the above transmitting member 101 to which the winding or the rewinding is performed between the two holders 110 and 120, and adjusting the intensity of the towing.

That is, according to the vibration presentation apparatus 100 of the present invention, as shown in the above FIG. 2, the above transmitting member 101 is towed between the holders 110 and 120 by means of the constant tension (the retaining tension) Tc, and the above tension Tc is modulated by superimposing the variation of the acoustic signal S and the like. As a result, the varying tension Ts that the above acoustic signal S and the like are superimposed can be transmitted to the above vibration presentation object O. (In the above FIG. 2, a vertical axis denotes tension (T) and a horizontal axis denotes time (t).)

Explaining this more concretely, in cases that, as shown in FIG. 3A, the transmitting member 101 is not wound around the vibration presentation object O and is abutted to the vibration presentation object O via an auxiliary member AM and the like around the vibration presentation object O such as the user, as shown in FIG. 3B, the transmitting member 101 is wound around the vibration presentation object O and the first holder is connected to the second holder, or as shown in FIG. 3C, the transmitting member 101 is completely wound one turn around the vibration presentation object O and the first holder is connected to the second holder, when the retaining tension Tc by means of towing the above transmitting member 101 is applied to the above transmitting member 101, this force is transmitted to the vibration presentation object O as the force from a periphery of the above vibration presentation object O to an inward direction.

When the above retaining tension Tc is varied based on the acoustic signal S and the like that are inputted from the external, the variation of the tension Ts is transmitted to the above vibration presentation object O as the variation of the force from the outer surface of the vibration presentation object O to the inward direction.

Then, corresponding to the variation of the force to the inward direction at the periphery of the above vibration presentation object O, as shown in dashed line arrows of FIG. 3A to FIG. 3C, a motion that the above periphery is directed to the inward direction and a motion that the above periphery is directed to the outward direction, occur. This is because the above vibration presentation object O has the drag against the force to the inward direction.

In the periphery of the above vibration presentation object O, that is, the region that the transmitting member 101 is abutted or wound, as a result of occurring the motions that are directed to the inward and outward directions, the vibration is generated on the above vibration presentation object O. Due to the above vibration, the vibration presentation to the vibration presentation object O is achieved, and the function of the vibration presentation apparatus is exerted.

This is the principle of the vibration presentation of the vibration presentation apparatus. In the present invention, in order to be based on the principle of the above vibration generation, the vibration presentation object O has the drag against the force to the inward direction in the region that the transmitting member 101 is abutted or wound, as described above, and is necessary to generate the tension to the above transmitting member 101.

Thus, in a case that the above vibration presentation object O is the user being a human, in order that body trunk has the drag, the above transmitting member 101 is abutted or wound around the breast of the above user, and in a thorax of the above user, the motion that the thorax is directed to the inward direction and the motion that the thorax is directed to the outward direction, occur in response to the tension variation of the above transmitting member 101. Thereby, the acoustic vibration and the like can be presented to the user.

Further, in the present invention, in order to be based on the principle of the above vibration generation, achieving the efficient vibration presentation is possible by being wound around the above vibration presentation object O in the larger region. Adopting the configuration by enclosing the above vibration presentation object O by means of the transmitting member 101 is to perform the further efficient vibration presentation.

In this connection, as shown in the above FIG. 3A, the vibration presentation is possible even in a case that the above transmitting member 101 is not wound around the vibration presentation object O and is abutted to the vibration presentation object O. As shown in the above FIG. 3B, the efficient vibration presentation is achieved in a case that the above transmitting member 101 is wound around the vibration presentation object O so as to construct a closed loop, the first holder is connected to the second holder, and the connected holders are disposed at the front side of the vibration presentation object O. As shown in the above FIG. 3C, the further efficient vibration presentation is achieved in a case that the above transmitting member 101 is completely wound one turn around the vibration presentation object O, the first holder is connected to the second holder, and the connected holders are disposed at the front side of the vibration presentation object O.

As well, as described above, if the retaining tension Tc and the varying tension Ts are generated in the apparatus, the vibration presentation is possible. Thus, the necessity that the two holders are connected each other does not necessarily exist. However, by connecting the holders, as described above, it is possible to improve the portability and ease of the handling. In the present invention, as described below, the two holders are not used, and adopting the configuration that the single holder is used is possible. In this case, it is possible to further improve the portability and the ease of the handling by adopting a configuration that the above transmitting member is detachable and connectable at a center portion or the like. When the above holders are used in the apparatus, it is effective to have the configuration that the above holders are abutted or pressed to the side portion of the vibration presentation object together with the above transmitting member. However, it is possible to present the effective vibration even when the above holders are not necessarily abutted or pressed to the side portion of the vibration presentation object depending on usage embodiments to the above vibration presentation object.

Next, a further concrete configuration example of the vibration presentation apparatus 100 that is the embodiment of the present invention will be described with reference to FIG. 4A to FIG. 4D and FIG. 5.

Figure 4A:
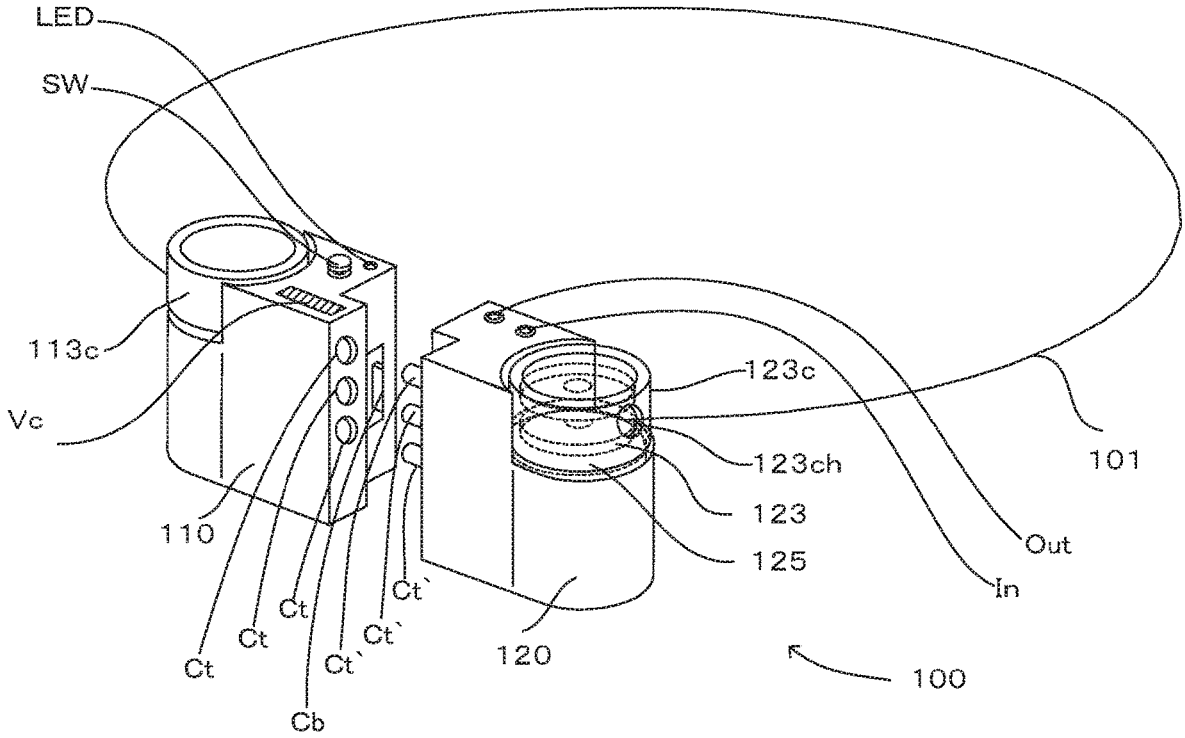
FIG. 4A, FIG. 4B, FIG. 4C and FIG. 4D show a vibration presentation apparatus 100 that is the embodiment of the present invention.
Figure 4B:
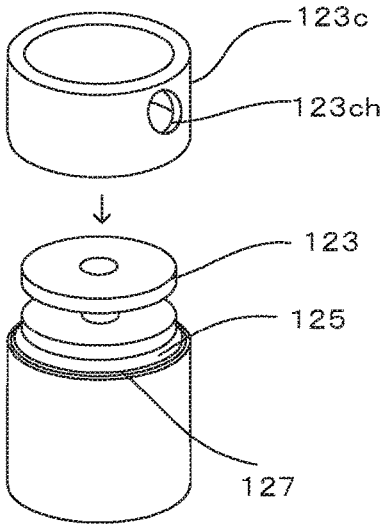
Figure 4C:
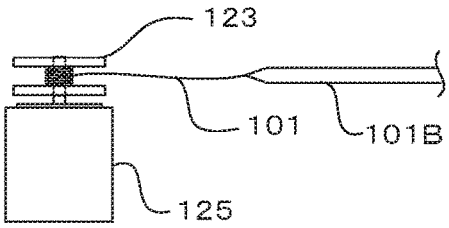
Figure 4D:
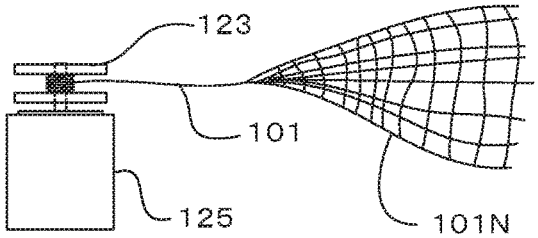

Here, FIG. 4A, FIG. 4B, FIG. 4C and FIG. 4D show the vibration presentation apparatus 100 that is the embodiment according to the present invention, FIG. 4A is a perspective view partially including a transparent view, FIG. 4B is a perspective view showing a configuration example of a motor portion, and FIG. 4C and FIG. 4D are side views showing a relationship among the motor, the bobbin and the transmitting member and the like.

As shown in FIG. 4A to FIG. 4D, the above vibration presentation apparatus 100 of the present invention comprises the transmitting member 101 having basically a line-shape or the like, the first holder 110 connected to one end of the transmitting member, and the second holder 120 connected to the other end of the transmitting member, as main components.

A power switch SW, an operation indicator LED, an adjustment dial Vc of the retaining tension Tc, and connector terminals Ct and a connection member Cb that are engaged with those which are provided with the above second holder, are disposed on the outer covering of the above first holder 110. An input connector In and an output connector Out of the acoustic information and the like from the above portable music reproducing apparatus WM and the like, and connector terminals Ct' and a connection member Cb' (not shown) that are engaged with those which are provided with the above first holder, are disposed on the outer covering of the above second holder 120.

Here, the above power switch SW turns ON or turns OFF the power supply of the apparatus. The input and output connectors (In and Out) of the acoustic signal S and the like input and output the acoustic information from the portable music reproducing apparatus WM and like that are separately provided. The connector terminals (Ct and Ct') input and output the control signal and the like by means of the control unit between the above two holders (110 and 120).

In the above components, the transmitting member 101 comprises the thread that is the line-shape member in the present embodiment.

Since the thread needs to effectively transmit the above tension variation to the vibration presentation object O, it is preferable to use a wire that has the low stretching rate such as high molecular weight polyethylene so that the towing by means of the above motor is not used for the deformation of the above thread.

Further, in the present invention, since the above transmitting member 101 is sufficient to effectively transmit the above tension variation to the vibration presentation object O, the above transmitting member 101 is not limited to the above line-shape member, and may be used by the belt-shape member or the net-shape member. For example, as shown in FIG. 4C and FIG. 4D, the combination of the line-shape member and the belt-shape member or the net-shape member can be formed. Mainly, as described below, the portion that is wound to the bobbin 123 can be constituted by the line-shape member 101, and the portion that is coiled to the vibration presentation object O and the like can be constituted by the belt-shape member 101B or the net-shape member 101N. In a case that the belt-shape member 101B or the net-shape member 101N is used as the transmitting member, the effect that the transmitting region of the vibration to the vibration presentation object O is larger than the case of using the line-shape member, is existed.

Next, in the above components, the first holder 110 retains one end of the transmitting member 101, and the second holder 120 retains the other end of the transmitting member 101. The first holder 110 and the second holder 120 have a basic function that the varying tension Ts is generated by towing the above transmitting member 101 from one end and the other end with the constant tension Tc, and modulating the above tension Tc by means of the acoustic signal S and the like.

In this connection, the above first holder 110 comprises the first bobbin 113 (not shown), the first bobbin cover 113*c*, and the first electric motor 115 (not shown). The above second holder 120 comprises the second bobbin 123, the second bobbin cover 123*c*, and the second electric motor 125. Further, the first bobbin 113 is connected to one end of the transmitting member 101, and the second bobbin 123 is connected to the other end of the transmitting member 101. By rotation of the two electric motors 115 and 125, winding or rewinding the transmitting member around the shaft that the bobbin comprises, is possible.

Here, in the above holders (110 and 120), since the basic structures of the motor portion and the bobbin portion of the first holder are the same as those of the second holder, the basic structures of the above bobbins (113 and 123), the bobbin covers (113*c* and 123*c*), and the electric motors (115 and 125) will be described by using the above holder 120.

As shown in FIG. 4A that is a partially transparent view, the above second holder 120 houses the above bobbin 123 and the electric motor 125 at one side of the above second holder 120. The above bobbin 123 is further covered with the bobbin cover 123*c* from an outside.

As shown in FIG. 4A to FIG. 4C, the bobbin 123 comprises two disks that are provided in parallel and a shaft that connects the above two disks at the center of the disks. A rotational shaft of the electric motor 125 as described below is formed in the above shaft so as to be rotatable in conjunction with the rotation of the above shaft.

The above shaft is connected to the other end of the transmitting member 101. In a case that the above shaft rotates or moves rotationally by rotating or moving rotationally of the above electric motor 125, the above transmitting member 101 can be wound or rewound around the above shaft.

As shown in FIG. 4A and FIG. 4B, the above bobbin cover 123*c* is formed on the generally cylinder-shape that the bottom surface is not existed and can cover the above bobbin 123 from the top surface and the side surface of the cylinder-shape. A hole 123*ch* is disposed on the side surface of the above cylinder-shape so that the above transmitting member 101 is inserted.

The above bobbin cover 123*c* covers the above bobbin 123 from the outside, and is moving-rotationally attached to the circular groove 127 that is disposed the above holder, at a bottom portion of the side surface of the above cylinder shape. The above bobbin cover 123*c* also has an introducing function that the transmitting member 101 which is inserted into the hole 123*ch* disposed on the side surface of the above bobbin cover 123*c*, enables to smoothly wind to or rewind from the bobbin 123.

The shaft of the above bobbin 123 is rotated or is moved rotationally by rotating the electric motor 125. Thereby, the electric motor 125 winds or rewinds the transmitting member 101 around the shaft of the bobbin 123, applies the constant tension Tc to the above transmitting member 101, and has a function that the varying tension Ts is generated by varying the above tension based on the acoustic signal S and the like.

Accordingly, the above electric motor 125 is used to the motor that has a fast response speed such as, for example, a coreless motor, so as to quickly generate the varying tension Ts depending on the variation of the above acoustic signal S and the like.

In the present apparatus 100, towing the above transmitting member 101 by means of the above electric motor 125 generates an initial tension (the retaining tension) Tc and the like in a certain strength range, and retains this tension.

In the present embodiment, as described below, a current that generates the towing force which can be used as the retaining tension Tc is antecedently set to the above electric motor 125. The present embodiment adopts the configuration that the acoustic signal S and the like are superimposed to the retaining tension Tc.

As described above, since the basic structures of the above electric motor and the above bobbin in the above two holders are common, the structures of the electric motor 125 and the bobbin 123 in the second holder 120 are basically the same as the structures of the electric motor 115 and the bobbin 113 in the first holder 110.

Furthermore, the above electric motor and the above bobbin are exemplified as a configuration example of the driving mechanism of the present invention. Therefore, the driving mechanism of the present invention is not limited to the above configuration. Not being limited to tow the transmitting member, as described above, any configuration that the predetermined retaining tension Tc is generated to the above transmitting member, and the varying tension Ts which is modulated to the retaining tension Tc can be generated, may be adopted. Therefore, for example, it is possible to adopt the configuration that the motor and a flat spiral spring are combined, as described below. The above driving mechanism enables to comprise a driving component such as the motor, the flat spiral spring, a voice coil, a speaker, a spring, a coil spring, a piezoelectric material (for example, polyvinylidene fluoride (PVDF), polylactic acid laminated film, and the like) and an electrically conductive polymer actuator or a combination thereof, and a motive power transmitting component such as the bobbin, a pulley, a gear and a worm gear or a combination thereof.

Next, returning to FIG. 4A, the configurations of the above first holder 110 and the above second holder 120 will continue to be described. As shown in the above FIG. 4A, in the apparatus 100 of the embodiment of the present invention, in addition to the driving mechanisms that comprise the above electric motors, the bobbins and the like, the control unit (not shown) is provided. A power supply (a battery) that supplies electric power to the driving mechanisms such as the above control unit and the electric motors are housed in the apparatus 100.

The above control unit controls the driving of the above electric motors 115 and 125. Thus, the above control unit has a control function that the above retaining tension Tc is generated by towing the above transmitting member 101 by means of the control of the driving mechanisms such as the above electric motors, and the varying tension Ts is generated by applying the variation, which is dependent on the acoustic signal S and the like inputted from the external input terminal In, to the above retaining tension Tc.

However, the above control unit is not limited to the above configuration, and a different configuration that has the above function can be adopted.

Figure 5:
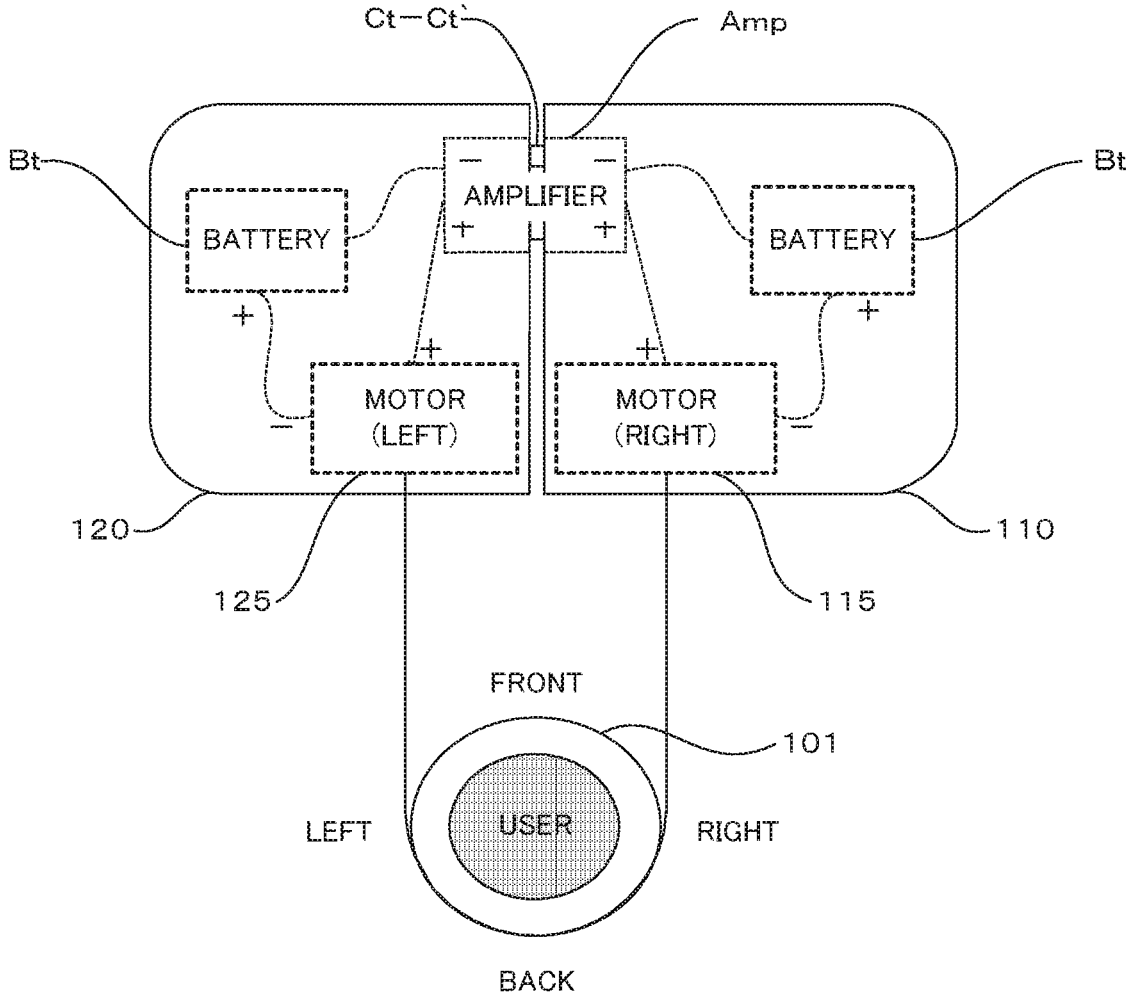
FIG. 5 is a configuration diagram showing a configuration example of a control system in accordance with the embodiment of the present invention.

In this connection, for example, as shown in FIG. 5, a configuration using an amplifier that amplifies the acoustic signal S and the like can be adopted instead of the above control unit. Here, the above FIG. 5 is a configuration diagram showing a configuration example of a control system in accordance with the embodiment of the present invention.

The configuration example exemplified in the above FIG. 5, which the user is treated as the vibration presentation object, has a configuration that the thread as the above transmitting member is completely coiled one turn around the breast of the above user, and the first holder 110 and the second holder 120 are connected at the front side of the above user.

Here, the two electric motors 115 and 125 are connected to the batteries Bt in the above two holders 110 and 120, and are connected to the amplifier Amp that is constituted by connecting the connector Ct which is disposed on the holder 110 to the connector Ct' which is disposed on the holder 120.

In the above configuration example, the above electric motors generate the retaining tension Tc by receiving constant direct currents from the above battery Bt. The above amplifier Amp generates the varying tension Ts by inputting the varied current corresponding to the above acoustic signal and the like, and the varying tension Ts generates the vibration to the above transmitting member.

Therefore, it is possible to present the vibration according to the present invention even in the above configuration.

As well, in the present invention, being different from the above configuration, it is possible to dispose the plural driving mechanisms such as the above electric motor on the one holder. In this case, as exemplified in FIG. 6A, FIG. 6B and FIG. 7, it is possible to adopt the configuration that the above predetermined retaining tension Tc is generated on the transmitting member by means of one of the driving mechanisms, and the above varying tension Ts is generated on the transmitting member by means of the other of the driving mechanisms.

Figure 6A:
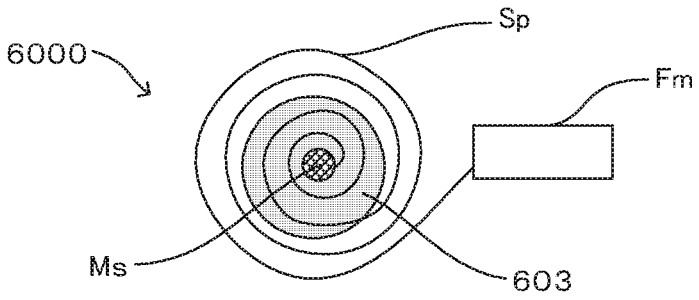
FIG. 6A and FIG. 6B show a configuration example that is adopted to a configuration which is provided with a flat spiral spring, the electric motor and the bobbin as a driving mechanism.
Figure 6B:
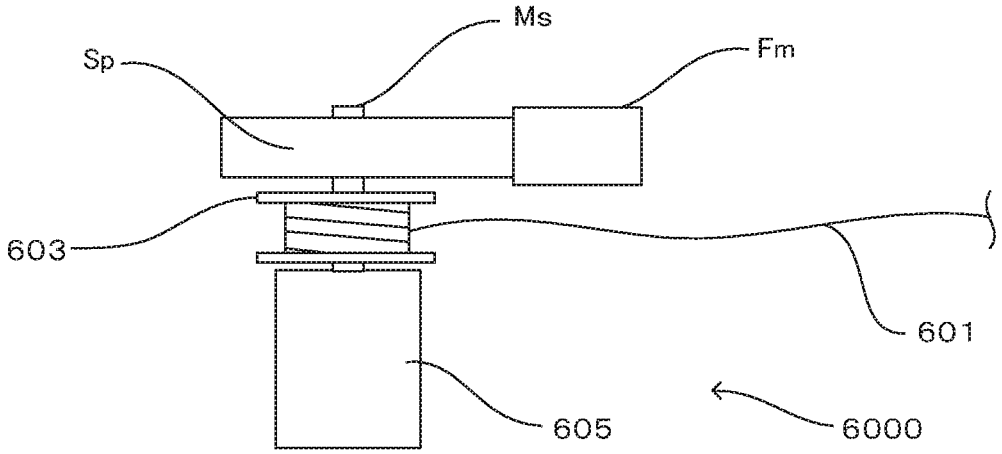

For example, the example of the above FIG. 6A and FIG. 6B adopts the configuration that the flat spiral spring, the electric motor and the bobbin are disposed as the driving mechanisms, that is, the configuration that the above predetermined retaining tension Tc is generated by the above flat spiral spring, and the above varying tension Ts is generated by the above electric motor.

That is, FIG. 6A and FIG. 6B shows the configuration example 6000 that adopts the configuration that the flat spiral spring, the electric motor and the bobbin are disposed as the driving mechanisms. FIG. 6A is a top view and FIG.

6B is a side view. In the above configuration example 6000, the bobbin 603 and the flat spiral spring Sp are coaxially connected on the shaft Ms of the above electric motor 605. The transmitting member 601 can be wound or be rewound on the bobbin 603 depending on moving-rotationally of the shaft Ms. The above flat spiral spring is fixed to the above holder by means of a fixing member Fm.

In such the configuration example 6000, considering the antecedently supposed winding length of the vibration presentation object, the length of the above transmitting member 601 is determined. By directly disposing the flat spiral spring Sp, which can wind or rewind the above transmitting member 601 having the above length, on the shaft Ms of the above electric motor 605, and moving rotationally the above shaft Ms, it is possible to generate the above retaining tension Tc. The above varying tension Ts can be generated by the above electric motor 605. Therefore, in a case that the above configuration example 6000 is adopted, for example, since it is not necessary to adopt the configuration as is described in the configuration example with reference to the above FIG. 5 that the retaining tension Tc is generated by applying the direct current from the battery Bt, it is possible to perform the power saving, extend the lifetime of the battery Bt, and suppress the heat of the above electric motor and the like.

Figure 7:
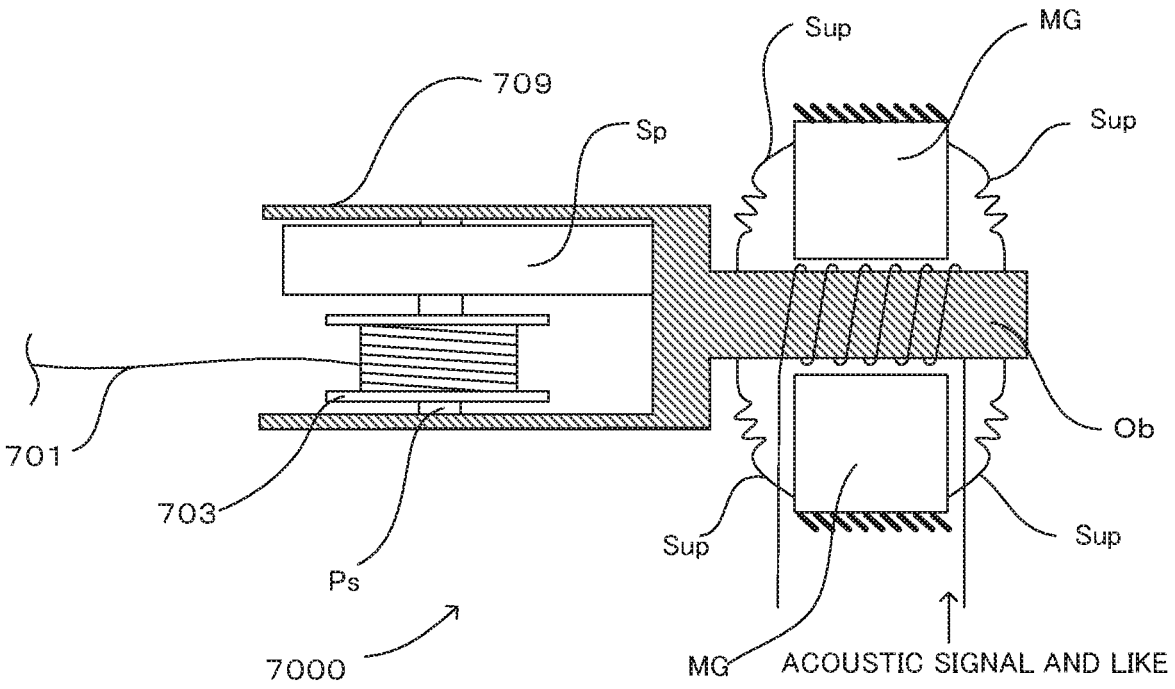
FIG. 7 is a side view showing the outline of the configuration example that is adopted to the configuration which is provided with the flat spiral spring, the bobbin and a voice coil as the driving mechanism.

In the example of the above FIG. 7, the configuration that the flat spiral spring, the bobbin and the voice coil (or other transducer, the speaker, or the like) are disposed is adopted, the above predetermined retaining tension Tc is generated by the above flat spiral spring, and the varying tension Ts is generated by the above voice coil (or other transducer, the speaker, or the like).

Here, the example of the above FIG. 7 shows the configuration example 7000 that adopts the configuration that the flat spiral spring, the bobbin and the voice coil (or other transducer, the speaker, or the like) are disposed as the driving mechanisms. FIG. 7 shows a schematic side diagram. In the present configuration example, the basic configuration such as the flat spiral spring and the bobbin is similar to that of the above configuration example 6000.

The driving mechanism of the above configuration example 7000 comprises a retaining tension section that the components thereof mainly occupy the left side of FIG. 7, and a varying tension section that the components thereof mainly occupy the right side of FIG. 7. The above retaining tension section comprises the flat spiral spring Sp, the bobbin 703, and a casing 709. The flat spiral spring Sp and the bobbin 703 are coaxially connected on the shaft Ps that is disposed on a central axis of the above bobbin 703, and the transmitting member 701 can be wound or be rewound around the bobbin 703 in response to move rotationally the above shaft Ps. Further, the above flat spiral spring Sp and the bobbin 703 are retained in the casing 709 of the retaining tension section, and the above casing 709 is vibratorily retained by the holder in the tangential direction of the above transmitting member 701 (left and right directions in FIG. 7) via a vibration body Ob and a support Sup, as described below. The above varying tension section comprises the voice coil VC (or other transducer, the speaker, or the like). The above voice coil or the like, for example, comprises magnets MG fixed to the holder, the vibration body Ob wound with a coil that is extended from the above holding tension section, and the support Sup, which is made of a soft material, for supporting the vibration body Ob, around which the coil is wound. The acoustic signal and the like are inputted into the above voice coil VC or the like.

Accordingly, in such the configuration example 7000, it is possible to generate the retaining tension to the transmitting member 701 by winding or rewinding the above transmitting member 701 on the above bobbin 703 by means of the flat spiral spring Sp of the above retaining tension section. It is possible to generate the varying tension to the transmitting member 701 by vibrating the bobbin 703 and the overall flat spiral spring Sp of the above retaining tension section, and the vibration body Ob that is wound with the above coil, in the tangential direction of the above transmitting member 701 that is corresponding to the left and right directions of the above FIG. 7, in response to the acoustic signal and the like inputted from the above voice coil or the like by the above varying tension section.

As described above, in a case of adopting the configuration that the above predetermined holding tension Tc is generated to the above transmitting member by one of the driving mechanisms, and the above varying tension Ts is generated by the other of the driving mechanisms, it is not necessary to input the acoustic signal S and the like into one of the driving mechanisms that generates the above holding tension Tc.

Returning to the configuration example as shown in FIG. 4A, the explanation will be continued. The vibration presentation apparatus 100 of the present invention having the configuration shown in the above FIG. 4A enables to perform the vibration presentation to the vibration presentation object by using the vibration presentation apparatus 100 as follows.

Figure 8:
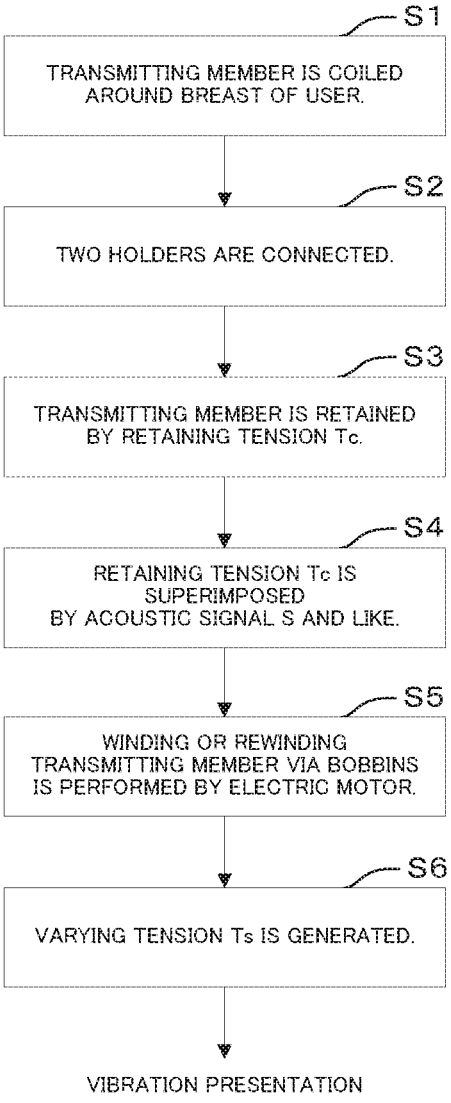
FIG. 8 is a flowchart showing a flow of a method for using the vibration presentation apparatus 100 that is the embodiment according to the present invention.

That is, in the present invention, for example, as shown in the flowchart of FIG. 8, in a case that the vibration presentation object O is the user being the human, at first, the user coils at least one turn of the transmitting member 101 around a breast and the like of the above user with clothes on (Step S1). At this time, even in a case that the transmitting member 101 is overlapped each other, if a material having a slip characteristic is used in the transmitting member 101, the transmitting of the tension variation is not largely affected.

Thereafter, the first holder 110 connected to one end of the transmitting member 101, and the second holder 120 connected to the other end of the transmitting member 101 are connected (Step S2). After the two holders 110 and 120 are connected, by driving the above vibration presentation apparatus 100, the above breast is retained by means of the constant retaining tension Tc (Step S3).

Continuously, when the acoustic signal S and the like is inputted into the above vibration presentation apparatus 100 (Step S4), the driving signal on a basis of the above acoustic signal S and the like is inputted into the above first electric motor 115 and the above second electric motor 125 via the above control unit. By cooperatively driving the first electric motor 115 and the second electric motor 125, winding or rewinding one end and the other end of transmitting member 101 on the above first bobbin 113 and the above second bobbin 123, is performed (Step S5). By converting the predetermined retaining tension Tc into the varying tension Ts based on the above driving signal (Step S6), the vibration is transmitted to the above vibration presentation object via the transmitting member.

In the above example, after the above transmitting member 101 is wound at least one turn around the breast of the above user and the above two holders are connected, the apparatus turns ON and drives. However, it is not limited to the above use. Winding the transmitting member may be performed after the apparatus turns ON and drives.

Further, as described above, the portion of the user body around which the transmitting member is wound is not limited to the breast, and may be the torso, the abdomen, the waist where for example, the belt or the like is fastened, a diagonal portion from the left (or right) shoulder to the right (or left) waist, or a combination thereof. In a case that winding is performed at plural portions, the plural vibration presentation apparatuses may be used. In a case that the transmitting member is wound around the stomach, since the user feels uncomfortable, it is preferred that coiling the transmitting member around the portion neighboring the stomach should be avoided.

In accordance with the vibration presentation apparatus according to the present invention, the vibration can be presented to the vibration presentation object by using the transmitting member such as the thread and the driving mechanism such as the motor. Thus, the presentation of the vibration by using the weight saving and compact apparatus against the conventional electric-mechanical vibration converter, is possible. Further, the vibration can be propagated to the wide range by using the transmitting member such as the above thread.

Further, in the vibration presentation apparatus, it is possible to adopt the method that the vibration is transmitted to the vibration presentation object such as the user by using the tension of the transmitting member such as the above thread. Consequently, to provide the weight saving and compact wearable vibration presentation apparatus, is possible. In a case that the transmitting member such as the above thread is wound around the breast or the like of the above user, the vibration is transmitted to the wide range around the breast or the like of the above user. Thus, it is possible to present the user via the portion around the above breast or the like with feeling as well as the listening to music in the hall and the like.

As well, the present invention is not limited to the above embodiment, and other embodiments can be adopted within the scope of gist of the present invention.

In this connection, in the above embodiment, the examples that the varying tension Ts is generated based on the acoustic signal S are mainly described. The signal based on the vibration presentation signal may be used, and is not necessarily limited to the acoustic signal S. Therefore, for example, in a case of performing the vibration presentation to the player of the game and the like, separately from an effect sound and music of the game, and the like, a tactile sense presentation signal may be used as the vibration presentation signal. That is, the varying tension Ts that is independently generated based on the tactile sense presentation signal may be used.

As described above, for example, not using the electric motors and the bobbins in the two holders, the configuration that the above electric motor and the above bobbins are used in only one of the holders can be adopted. Even in such the configuration, it is possible to apply the tension to the above transmitting member, and vary the tension.

Figure 9A:
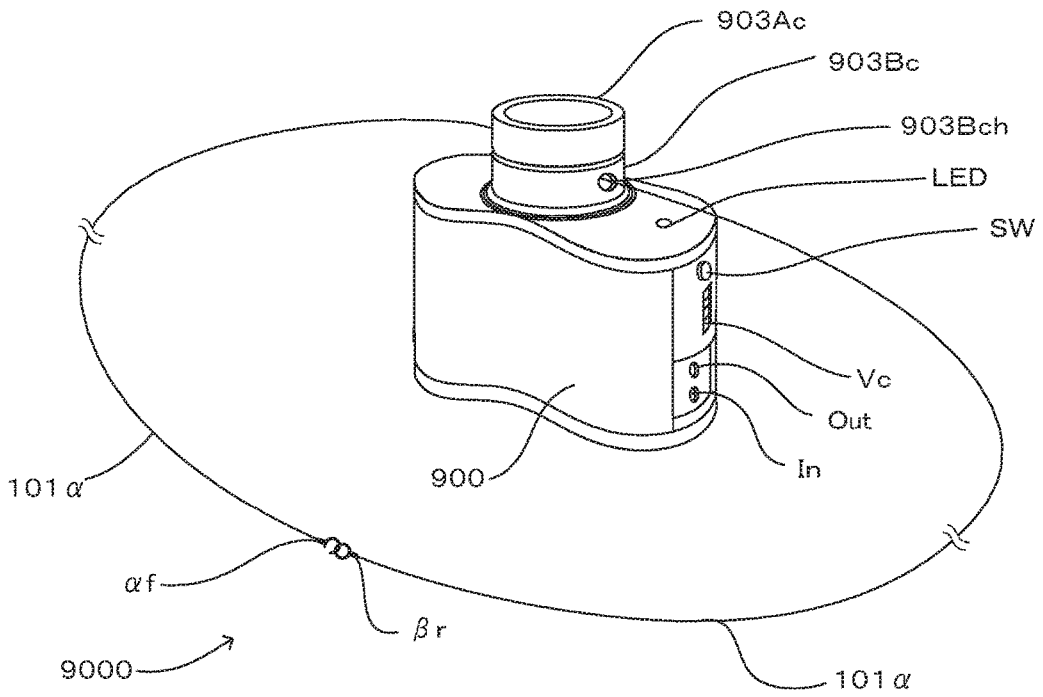
FIG. 9A, FIG. 9B and FIG. 9C show the configuration example that the transmitting member is dis-connectable, and one end and the other end of the transmitting member are retained by a single holder.
Figure 9B:
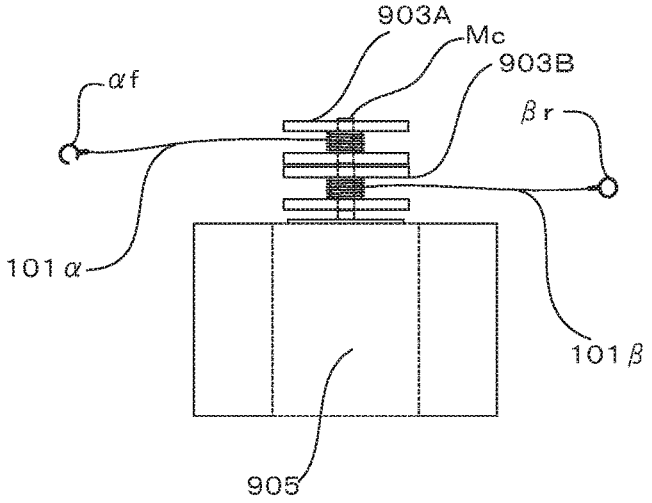
Figure 9C:
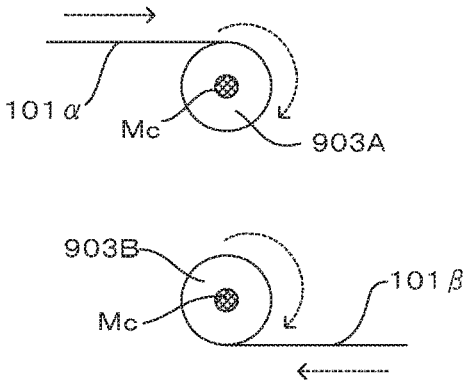

In the above embodiment, the configuration that the apparatus comprises the above two holders is described. However, in the present invention, for example, as shown in FIG. 9A, FIG. 9B and FIG. 9C, the above transmitting member is separable, and the single holder can retain one end and the other end of the transmitting member in the not separating state. It is possible to adopt the configuration that the side portion of the transmitting member is abutted to the portion of the vibration presentation object or is coiled to the vibration presentation object, and the vibration is transmitted to the vibration presentation object by generating the retaining tension Tc and the varying tension Ts to the above transmitting member by means of the driving mechanisms disposed on the above single holder.

That is, the above FIG. 9A, FIG. 9B and FIG. 9C show the vibration presentation apparatus 9000 that is the above embodiment having the above configuration. FIG. 9A is a perspective view, FIG. 9B is a side view in a case that the two bobbin covers which constitute the driving mechanism of the above vibration presentation apparatus 9000 are removed, and connection sections are disconnected, and FIG. 9C is a top view showing a concept of a status when the above transmitting member is connected to the two bobbins which are connected to a rotational shaft of the electric motor provided with the above holder.

In the above vibration presentation apparatus 9000, as shown in FIG. 9A and FIG. 9B, the above single holder 9000 comprises the two bobbins 903A and 903B, and the electric motor 905 as the driving mechanisms. The above two bobbins 903A and 903B are coaxially connected on the shaft Mc of the above electric motor 905, and stacks up and down.

As shown in FIG. 9C, one end and the other end of the above transmitting member 101 are connected to the above two bobbins 903A and 903B in different directions (in both directions of the above holder 900) through the holes 903Ach (not shown) and 903Bch of the bobbin covers 903Ac and 903Bc, respectively. That is, one end and the other end of the above transmitting member 101 are be connected to the above two bobbins so as to be capable of winding (for example, winding the transmitting member in the straight arrow direction which is shown by the dashed line in the above FIG. 9C) or rewinding on the above two bobbins in conjunction with the moving-rotationally direction of the above electric motor 905 (for example, in the curved arrow direction which is shown by the dashed line in the above FIG. 9C).

Further, in the above vibration presentation apparatus 9000, the above transmitting member 101 comprises connection sections that are disposed at a substantially central position (a substantially equal distance position from one end and the other end of the above transmitting member 101) so as to separate the two transmitting members 101α and 101β. As connection members that constitute the connection sections, a hook αf is disposed at one end 101α of the above transmitting member, and a ring βr that is engaged with the hook αf is disposed at the other end 101β of the above transmitting member. Thus, the above transmitting members 101α and 101β are separable and connectable by means of the above connection members αf and βr of the above connection sections.

In this connection, for example, in a case that the vibration presentation apparatus 9000 that has the above configuration is used to the user, the basic use method is similar to that of the vibration presentation apparatus 100. By appropriately separation or connection of the above transmitting members 101α and 101β, the above transmitting members 101α and 101β are wound at least one turn around the portion of the body of the above user (the breast, the torso, the waist (the position where the belt or the like is fastened), or the like) with clothes on. After the above winding, it is possible for the user to feel the vibration on a basis of the above acoustic signal and the like by driving the above vibration presentation apparatus 9000. In a case of adopting the above configuration, by using the single electric motor and the two bobbins, providing the efficient and weight saving vibration presentation apparatus is possible.

Figure 10:
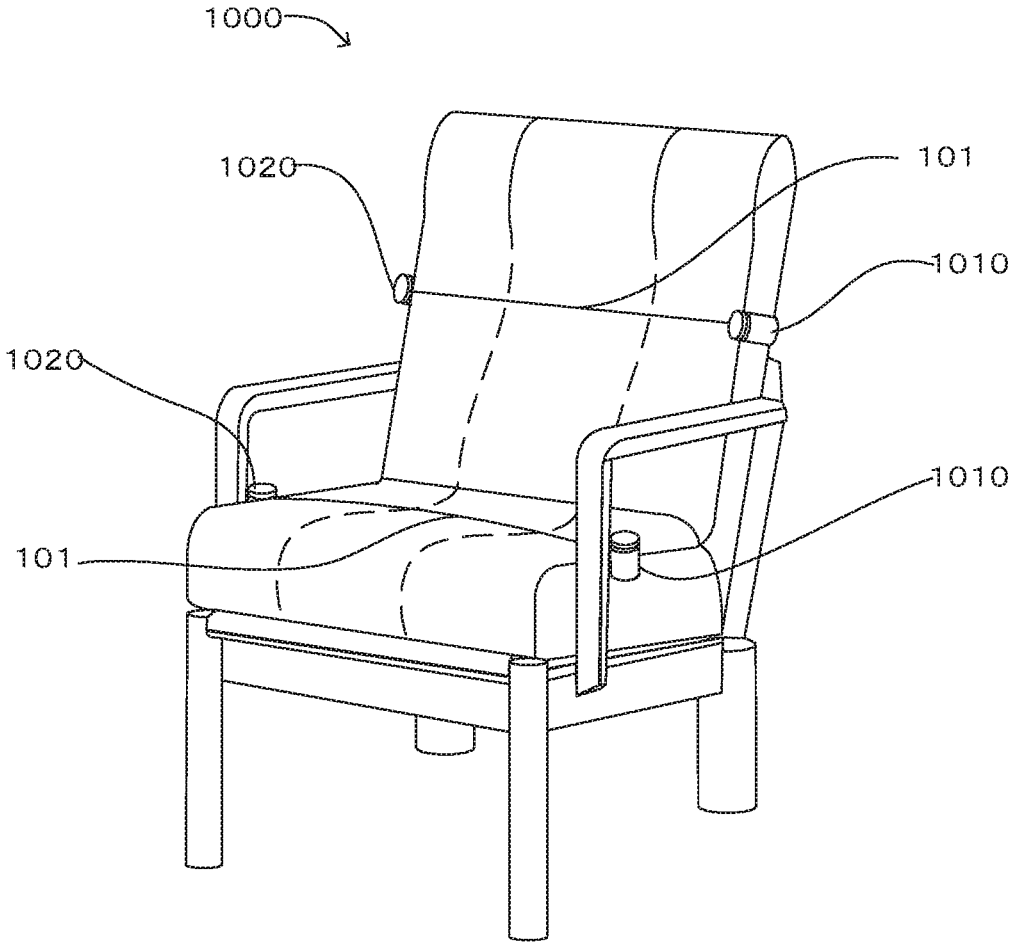
FIG. 10 is a perspective view showing the vibration presentation apparatus 1000 that is the embodiment according to the present invention.

As the different configuration example, it is possible to adopt the vibration presentation apparatus of the present invention that comprises the two holders, for example, the vibration presentation apparatus 1000 that is the embodiment as shown in FIG. 10, to an existing chair.

In the example shown in the above FIG. 10, the vibration presentation apparatus 1000 of the present invention comprises the first holder 1010 connected to one end of the transmitting member, and the second holder 1020 connected to the other end of the transmitting member. The above holders 1010 and 1020 are detachable to the above chair.

Accordingly, by adopting such the configuration, even in a case that the apparatus is portable, it is possible to perform the vibration presentation by means of attaching the holders 1010 and 1020 to the above existing chair when the user sits on the chair. Therefore, in a case that the vibration presentation is performed when moving the body of the user is not necessarily required, that is, a relaxation situation, or vibroacoustic therapy and the like, performing the vibration presentation by using the present invention can be extremely easy.

In a case that the vibration presentation apparatus according to the present invention is attached to the chair, the configuration that the vibration presentation apparatus comprises the first holder 1010 connected to one end of the transmitting member 101 and the second holder 1020 connected to the other end of the transmitting member 101, and the above holders 1010 and 1020 are detachable to the above chair, is not limited, and other configurations can be adopted.

For that reason, for example, if the transmitting member 101 is disposed on the surface of the above chair and the tension variation is changeable, it is possible to present the vibration to the vibration presentation object regardless of the number of the holders and the configuration of the driving mechanisms.

The transmitting member, the holders, the control unit and the like are not necessarily detachable to the above chair, and they can be fixed to the chair, antecedently. In this case, for example, the vibration presentation apparatus can be used to the seats of the theater and the like.

Accordingly, in accordance with the present invention, by combining the transmitting member and the driving mechanisms that are disposed on the holders, as described above, the predetermined tension (the retaining tension and the varying tension) can be generated to the above transmitting member, and performing the vibration presentation to the vibration presentation object can be extremely efficient.

In the present invention, one of or both of the retaining tension Tc and the varying tension Ts are generated by expanding and contracting the transmitting member. Thereby, it is possible to achieve the configuration that the vibration presentation is performed.

Figure 11A:
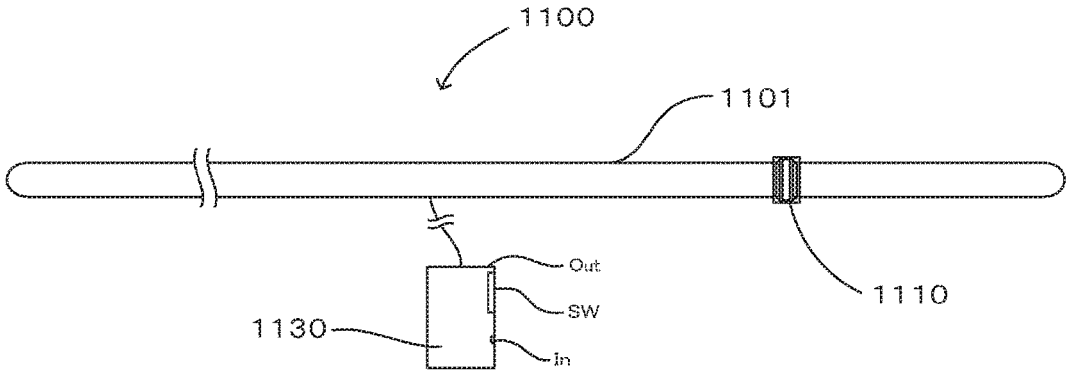
FIG. 11A, FIG. 11B and FIG. 11C show the vibration presentation apparatus 1100 that is the embodiment according to the present invention.
Figure 11B:
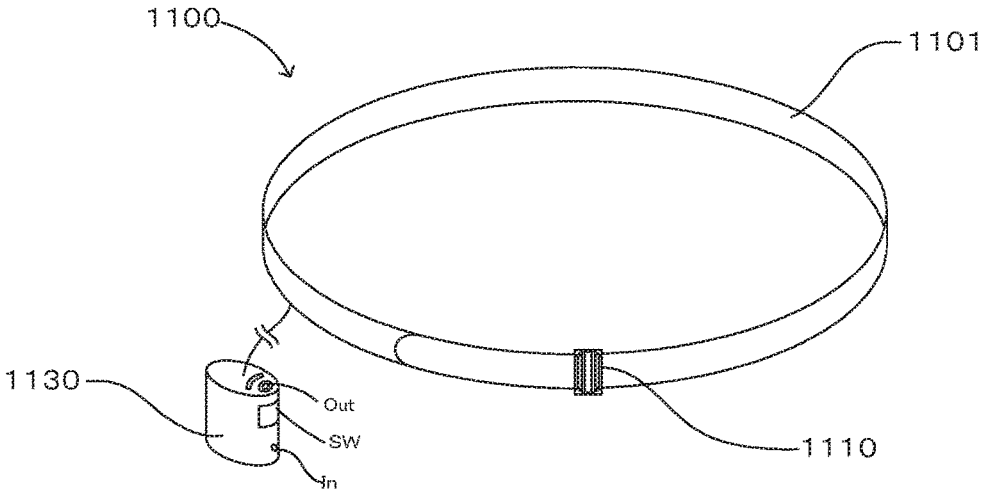
Figure 11C:
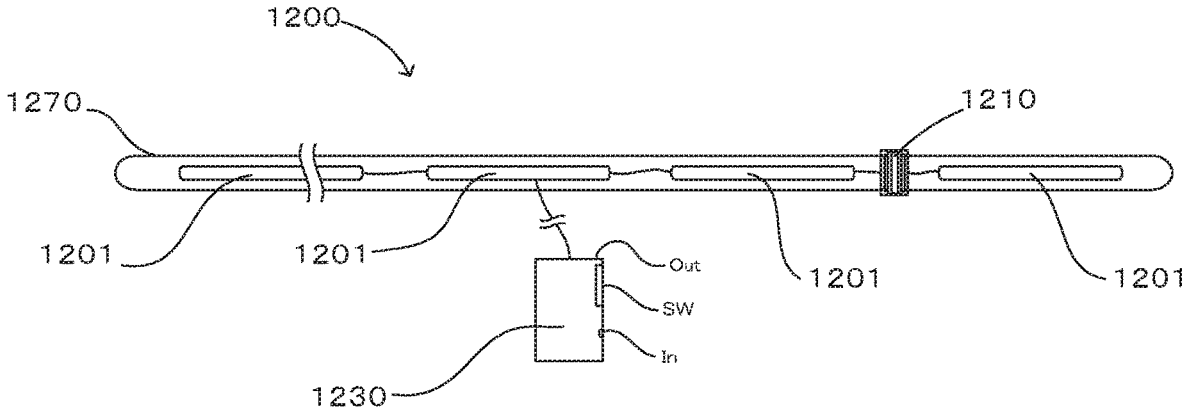

Consequently, for example, FIG. 11A, FIG. 11B and FIG. 11C show the vibration presentation apparatus 1100 that is the embodiment according to the present invention. The transmitting member that expands and contracts itself and enables to present the vibration is molded into a belt-shape. The vibration presentation by using this transmitting member can be achieved. Here, FIG. 11A is a plan view showing the outline of the configuration of the vibration presentation apparatus 1100 in a case that such the transmitting member 1101 is formed with a belt-shape, FIG. 11B is a perspective view showing an example that the belt illustrated in FIG. 11A which is composed of the transmitting member 1101 constructs the closed loop by being connected to one end side and the other end side, and being coiled one turn via a belt adjuster 1110, and FIG. 11C is a plan view showing an example that the transmitting members 1201 are intermittently disposed in a base material of the belt 1270 and are electrically connected each other, being different from FIG. 11A and FIG. 11B.

As shown in FIG. 11A, FIG. 11B and FIG. 11C, the example of the vibration presentation apparatus 1100 overall comprises the transmitting member 1101, the belt adjuster 1110 provided with the transmitting member 1101 and the control unit 1130.

For example, because of utilizing the piezo effect, the piezoelectric material such as stretchable ferroelectric polymers (for example, polyvinylidene fluoride (PVDF), polylactic acid laminated film, or the like), an electrically conductive polymer actuator, or the like is used for the transmitting member 1101. Since such the material can expand and contract itself by applying a predetermined current to the material at a predetermined timing, the material is formed so as to be used as the actuator and like. Then, in the vibration presentation apparatus 1100, the transmitting member 1101 expands and contracts by applying the above predetermined current and the like from the control unit 1130 to the transmitting member 1101 that is composed of such the material. Thereby, the varying tension Ts is applied to the vibration presentation object, and then the vibration is presented to the vibration presentation object.

The above belt-shape transmitting member 1101 is wound around the vibration presentation object, and the belt adjuster 1110 is used for retaining the wound state and enables to use a buckle of the belt and the like that is generally used. Thus, in the vibration presentation apparatus 1100, in a case that the vibration presentation object is the user, the above user winds the transmitting member 1101 around the breast and the like of the user and retains the above state by using the belt adjuster and the holding tension Tc can be generated. Therefore, with reference to the above transmitting member 1101, if only the varying tension Ts on a basis of the acoustic information and the like is generated, it is possible for user to perform the vibration presentation.

The control unit 1130 is the apparatus that controls for expanding and contracting the transmitting member 1101 by applying the above predetermined current and the like to the transmitting member 1101. Thus, the control unit 1130 is electrically connected to the transmitting member 1101, and is embedded in the power supply such as the battery or the like. The power switch SW, the adjustment dial and the like, as well as those which are disposed on the holder 110 described in the vibration presentation apparatus 100 according to the present invention, are disposed on the outer covering of the control unit 1130. The acoustic signal S and the like from the portable music reproducing apparatus WM and the like, as shown in FIG. 1, are inputted into and are outputted from the control unit 1130.

Figure 12:
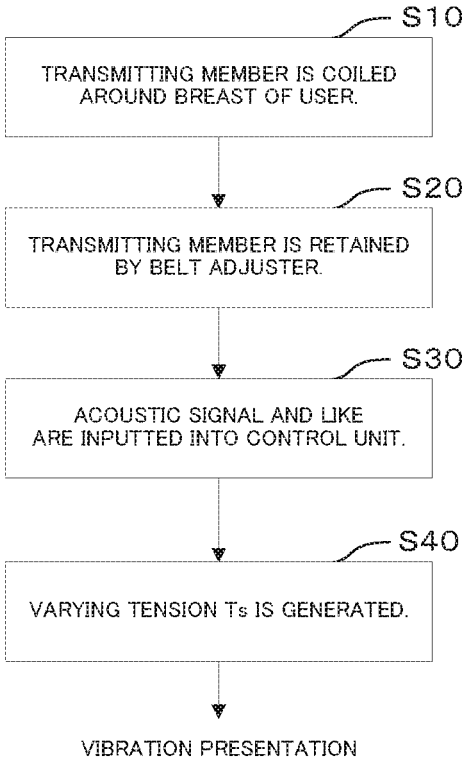
FIG. 12 is a flowchart showing the flow of the method for using the vibration presentation apparatus 1100 that is the embodiment according to the present invention.

In a case of the above vibration presentation apparatus 1100, the vibration presentation according to the present invention is performed, for example, in accordance with the flowchart shown in FIG. 12, as well as the above vibration presentation apparatuses 100 and 9000.

That is, the method for using the vibration presentation apparatus 1100 in accordance with the embodiment according to the present invention basically is similar to the flowchart of the method for the vibration presentation apparatus 100 as shown in FIG. 8. However, since the transmitting member 1101 itself has the stretch function in a case of the vibration presentation apparatus 1100, the vibration presentation apparatus 1100 is different from the vibration presentation apparatus 100 with respect to the points that the vibration presentation apparatus 1100 does not have the holder such as the vibration presentation apparatus 100 and does not need to apply the retaining tension Tc by another means. The vibration presentation apparatus 1100 can apply the retaining tension Tc by winding the belt-shape transmitting member 1101 around the vibration presentation object by using the belt adjuster 1110.

Thus, in a case that the vibration presentation apparatus 1100 according to the present embodiment, as shown in the flowchart of FIG. 12, when the vibration presentation object O is the user being a human, at first the user winds at least one turn of the transmitting member 1101 around the breast and the like of the above user with clothes on (Step S10).

At this time, after winding the transmitting member 1101 around the breast and the like, the transmitting member 1101 is retained at the breast and the like of the user via the belt adjuster 1110 (Step S20). For that reason, the vibration presentation apparatus 1100 does not need to apply the retaining tension Tc by another means, such as the vibration presentation apparatus 100 according to the above embodiment.

Continuously, the acoustic signal S and the like are inputted into the control unit 1130 of the vibration presentation apparatus 1100 (Step S30). The driving signal on a basis of the acoustic signal S and the like is inputted into the transmitting member 1101. By expanding and contracting the transmitting member 1101 itself in response to the driving signal, the varying tension Ts based on the above driving signal is generated (Step S40). Thereby, the vibration is transmitted to the vibration presentation object via the transmitting member 1101.

In this connection, as described above, an enforcement of the present invention is enabled even by using the transmitting member itself having the stretch function. In a case of the vibration presentation apparatus 1100, the transmitting member 1101 itself is formed with the belt-shape, however, it is not limited to the above configuration in a case that the transmitting member itself has the stretch function. Thus, for example, the base material 1270 of the belt is formed separately, such as the vibration presentation apparatus 1200 according to the embodiment of the present invention shown in FIG. 11B. Materials 1201 having a self-stretching function as the transmitting member itself may be intermittently disposed in the base material 1270 of the belt and may be electrically connected each other, and then the materials 1201 may be electrically connected to the control unit 1230.

In a case of adopting such the configuration, the material, which similarly expands and contracts in response to expanding and contracting by means of the transmitting member 1201 itself, are used in the base material 1270 of the above belt. The expanding and the contracting of the transmitting member 1201 are transmitted to the vibration presentation object via the base material 1270 of the belt, and then the vibration can be transmitted to the vibration presentation object.

Figure 13A:
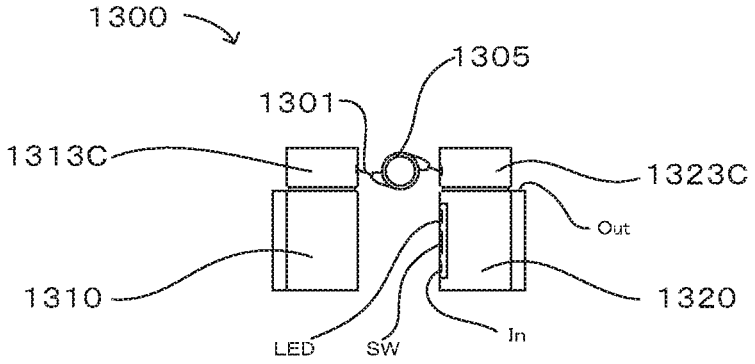
FIG. 13A and FIG. 13B show the vibration presentation apparatus 1300 that is the embodiment according to the present invention.
Figure 13B:
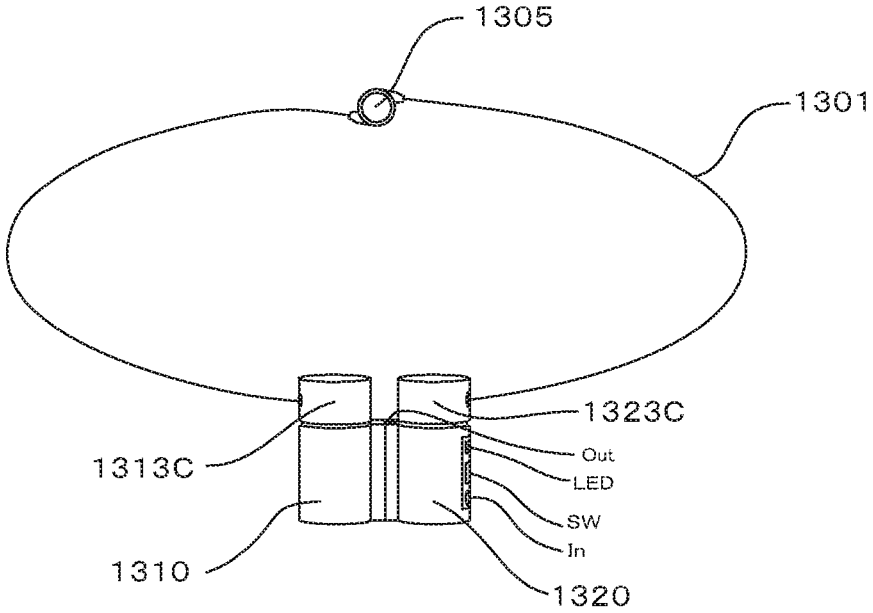
Figure 14A:
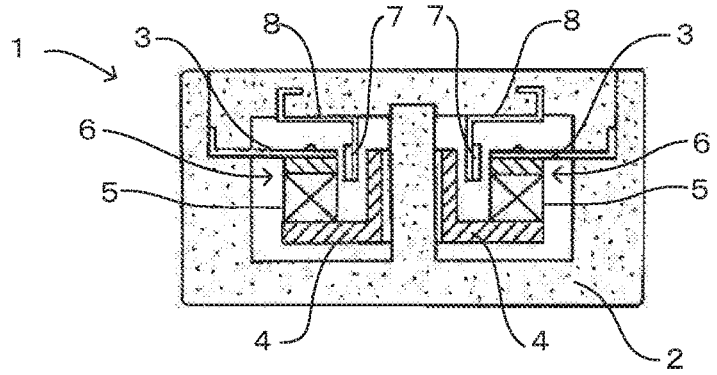
FIG.14A PRIOR ART
FIG. 14A, FIG. 14B and FIG. 14C show examples of the conventional art.
Figure 14B:
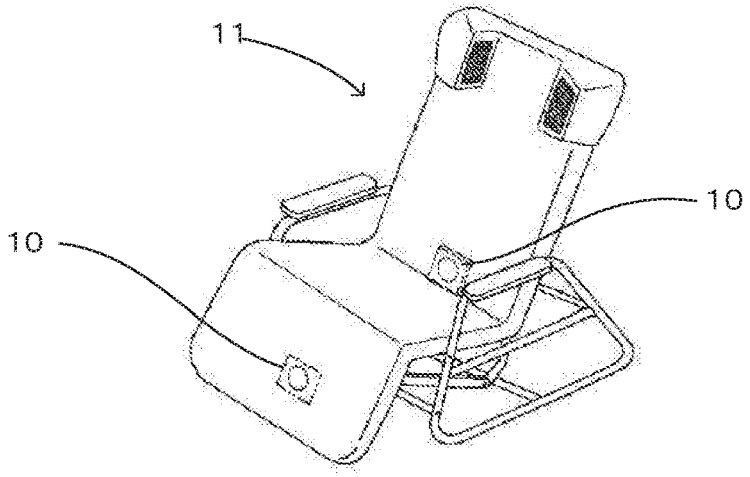
FIG.14B PRIOR ART
Figure 14C:
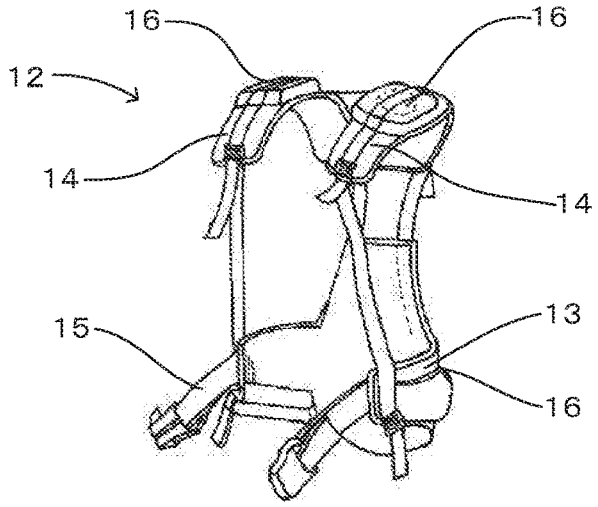
FIG.14C PRIOR ART

Further, in the present invention, for example, the vibration presentation apparatus 1300 that is a further different embodiment is shown in FIG. 13A and FIG. 13B. The vibration presentation apparatus 1300 comprises a draw-in mechanism 1305 of the transmitting member 1301 that the both ends of the transmitting member 1301 are drawn inwardly. The above draw-in mechanism 1305, which alternates the driving mechanism or cooperates with the driving mechanism, can generate the predetermined tension to the transmitting member 1301 by winding the transmitting member 1301 on the draw-in mechanism 1305. Here, FIG. 13A and FIG. 13B show the vibration presentation apparatus 1300 that is the embodiment according to the present invention, FIG. 13A is a plan view showing the outline of the configuration in a case that the transmitting member 1301 is wound in a draw-in mechanism 1305, and FIG. 13B is a perspective view showing a state that the transmitting member 1301 is rewound from the draw-in mechanism 1305 shown in FIG. 13A and the two holders 1310 and 1320 are connected.

The vibration presentation apparatus 1300 shown in the above FIG. 13A and FIG. 13B, which is similar to the above vibration presentation apparatus 100 of the present invention in appearance, comprises the first holder 1310, the first bobbin cover 1310*c*, the second holder 1320, the second bobbin cover, the power switch SW disposed on the second holder, and the like. The draw-in mechanism 1305 that the both ends of the transmitting member 1301 are drawn inwardly is provided with the vibration presentation apparatus 1300, and is not provided with the vibration presentation apparatus 100. This is a different point between the vibration presentation apparatus 1300 and the vibration presentation apparatus 100.

The above draw-in mechanism 1305 comprises a mechanism that the transmitting member 1301 is drawn from the both ends of the draw-in mechanism 1305 to the inside of the draw-in mechanism 1305, and is housed in the inside of the draw-in mechanism 1305. A mechanism (for example, a cord retraction assembly which is disclosed in Japan Unexamined Patent Publication No. 2002-536943) that, for example, utilizes the flat spiral spring and the like, which are generally used in a cord reel and a retractable cable adapter and the like, can be used for the above mechanism.

For that reason, in a case that the above draw-in mechanism 1305 is disposed, since the transmitting member 1301 can be retained by the predetermined retaining tension Tc by means of the draw-in mechanism 1305, in a case that the first holder 1310 and the second holder 1320 as well as the above vibration presentation apparatus 100 are used, the above draw-in mechanism 1305, which alternates the driving mechanisms such as the motor disposed on the first holder 1310 or cooperates with the driving mechanisms, can generate the predetermined tension Tc to the transmitting member 1301 by winding the transmitting member 1301 into the inside of the draw-in mechanism 1305.

Therefore, in the above case, the driving mechanism that is disposed on the above first holder 1310 is solely used to generate the varying tension Ts to the transmitting member 1301. Thereby, the vibration presentation can be performed to the vibration presentation object.

As well, in the example of the above vibration presentation apparatus 1300, an example of using the two holders 1310 and 1320 is described. However, it is not limited to this case, using only the one holder such as the above vibration presentation apparatus 9000 is possible. In this case, it is possible to generate the retaining tension Tc to the transmitting member by alternating the driving mechanisms of the above embodiment 9000 or cooperating with the driving mechanism of the above embodiment 9000.

In a case of using the draw-in mechanism 1305, as described above, it is possible to retain the transmitting member 1301 by means of the predetermined holding tension Tc. Then, for example, in a case that the driving mechanisms 7000 described in FIG. 7 is used in the portions of 1313C and 1323C described as the components of the holders shown in FIG. 13A and FIG. 13B, the configuration that the flat spiral spring Sp, the bobbin 703 and the rotational shaft Ps of the bobbin are eliminated, the transmitting member 1301 is directly connected to the casing 709, and the vibration presentation by means of the varying tension Ts from the voice coil VC is performed, is possible.

EXPLANATION OF REFERENCE NUMERALS

100, 1000, 1100, 1300, 9000 vibration presentation apparatus
101, 101*a*, 10113, 701, 1101, 1301 transmitting member
101B belt-shape transmitting member
101N net-shape transmitting member
110, 1010 first holder
113 first bobbin
113*c*, 1313*c* first bobbin cover
113*ch* hole of first bobbin cover
115 first motor
120, 1020 second holder
123 second bobbin
123*c*, 1323*c* second bobbin cover
123*ch* hole of second bobbin cover
125 second motor
703, 903A, 903B bobbin
709 casing (of retaining tension section)
900 holder
903Ac, 903Bc bobbin cover
903Bch hole of bobbin cover
905 motor
1110 belt adjuster
1130, 1230 control unit
1305 draw-in mechanism
S acoustic signal
Tc retaining tension
Ts varying tension
AM auxiliary member
O vibration presentation object (user or the like)
WM portable music reproducing apparatus
Vc varying tension adjustment dial
Cb connection member
Ct, Ct' connector
Amp amplifier
Bt battery
Ms motor shaft
Sp flat spiral spring
Fm fixing member
Ps shaft
VC voice coil
Ob vibration body
Sup support
MG magnet

The invention claimed is:

1. A vibration presentation apparatus comprising a transmitting member and a control unit, wherein a side portion of said transmitting member is abutted to a portion of a vibration presentation object or is wound to said vibration presentation object, said transmitting member comprises a first holder connected to one end of said transmitting member and a second holder connected to the other end of said transmitting member, a first driving mechanism that applies said tension to said transmitting member is provided with said first holder, said first driving mechanism comprises a first bobbin and a first electric motor connected to said first bobbin, one end of said transmitting member is connected to said first bobbin, by driving said first electric motor and winding or rewinding one end of said transmitting member on said first bobbin, one end of said transmitting member is towed and said predetermined tension is generated to said transmitting member, a driving signal on a basis of a vibration presentation signal is inputted into said first driving mechanism, by driving said first driving mechanism, said predetermined tension is varied based on said driving signal on a basis of said vibration presentation signal, and vibration is transmitted to said vibration presentation object via said transmitting member.

2. The vibration presentation apparatus according to claim 1, wherein said first driving mechanism further includes another driving mechanism that is different from said first bobbin and said first electric motor connected to said first bobbin, said another driving mechanism generates said predetermined tension, and said first bobbin and said first electric motor connected to said first bobbin vary said predetermined tension based on said driving signal on a basis of said vibration presentation signal.

3. The vibration presentation apparatus according to claim 1, wherein said first driving mechanism further includes another driving mechanism that is different from said first bobbin and said first electric motor connected to said first bobbin, said first bobbin and said first electric motor connected to said first bobbin generate said predetermined tension, and said another driving mechanism varies said predetermined tension based on said driving signal on a basis of said vibration presentation signal.

4. The vibration presentation apparatus according to claim 2, wherein said another driving mechanism comprises a driving component such as a motor, a flat spiral spring, a voice coil, a speaker, a spring, a coil spring, a piezoelectric material and an electrically conductive polymer actuator or a combination thereof, and a motive power transmitting component such as a bobbin, a pulley, a gear and a worm gear or a combination thereof.

5. The vibration presentation apparatus according to claim 1, wherein a second driving mechanism that applies said tension to said transmitting member is provided with said second holder, said driving signal on a basis of said vibration presentation signal is inputted into said first driving mechanism and said second driving mechanism, by cooperatively driving said first driving mechanism and said second driving mechanism, said predetermined tension is applied to said transmitting member, and said vibration is transmitted to said vibration presentation object via said transmitting member by varying said predetermined tension based on said driving signal.

6. The vibration presentation apparatus according to claim 5, wherein said second driving mechanism includes at least two sub-driving mechanisms.

7. The vibration presentation apparatus according to claim 6, wherein one of said at least two sub-driving mechanisms generates said predetermined tension to said transmitting member and the others of said at least two sub-driving mechanisms vary said predetermined tension based on said driving signal.

8. The vibration presentation apparatus according to claim 5, wherein said second driving mechanism comprises a driving component such as a motor, a flat spiral spring, a voice coil, a speaker, a spring, a coil spring, a piezoelectric material and an electrically conductive polymer actuator or a combination thereof, and a motive power transmitting component such as a bobbin, a pulley, a gear and a worm gear or a combination thereof.

9. The vibration presentation apparatus according to claim 5, wherein said second driving mechanism comprises a flat spiral spring, a voice coil and a bobbin, said flat spiral spring is supported by said voice coil and said bobbin is connected to a shaft of said flat spiral spring, said transmitting member is connected to said bobbin and is wound or rewound on said bobbin, said flat spiral spring winds or rewinds said transmitting member via said bobbin, said transmitting member is towed and said predetermined tension is generated to said transmitting member, and said driving signal on a basis of said vibration presentation signal is inputted into said voice coil.

10. The vibration presentation apparatus according to claim 5, wherein said second driving mechanism comprises a second bobbin and a second electric motor connected to said second bobbin, the other end of said transmitting member is connected to said second bobbin, said driving signal on a basis of said vibration presentation signal is inputted into said first electric motor and said second electric motor, by cooperatively driving said first electric motor and said second electric motor and winding or rewinding one end and the other end of said transmitting member on said first bobbin and said second bobbin respectively, said transmitting member is towed by means of said predetermined tension, and said vibration is transmitted to said vibration presentation object via said transmitting member by varying said predetermined tension based on said driving signal.

11. The vibration presentation apparatus according to claim 6, wherein one of said at least two sub-driving mechanisms comprises a second bobbin and a second electric motor connected to said second bobbin, the other end of said transmitting member is connected to said second bobbin, said driving signal on a basis of said vibration presentation signal is inputted into said first electric motor and said second electric motor, by cooperatively driving said first electric motor and said second electric motor and winding or rewinding one end and the other end of said transmitting member on said first bobbin and said second bobbin respectively, said transmitting member is towed by means of said predetermined tension, and said vibration is transmitted to said vibration presentation object via said transmitting member by varying said predetermined tension based on said driving signal.

12. A vibration presentation apparatus comprising a transmitting member and a control unit, wherein a side portion of said transmitting member is abutted to a portion of a vibration presentation object or is wound to said vibration presentation object, said transmitting member comprises a first holder connected to one end of said transmitting member and a second holder connected to the other end of said transmitting member, a first driving mechanism that applies said tension to said transmitting member is provided with said first holder, said first driving mechanism comprises a flat spiral spring, a voice coil and a bobbin, said flat spiral spring is supported by said voice coil and said bobbin is connected to a shaft of said flat spiral spring, said transmitting member is connected to said bobbin and is wound or rewound on said bobbin, said flat spiral spring winds or rewinds said transmitting member via said bobbin, said transmitting member is towed and said predetermined tension is generated to said transmitting member, said driving signal on a basis of said vibration presentation signal is inputted into said voice coil, by driving said first driving mechanism, said predetermined tension is varied based on said driving signal on a basis of said vibration presentation signal, and vibration is transmitted to said vibration presentation object via said transmitting member.

13. The vibration presentation apparatus according to claim 12, wherein a second driving mechanism that applies said tension to said transmitting member is provided with said second holder, said driving signal on a basis of said vibration presentation signal is inputted into said first driving mechanism and said second driving mechanism, by cooperatively driving said first driving mechanism and said second driving mechanism, said predetermined tension is applied to said transmitting member, and said vibration is transmitted to said vibration presentation object via said transmitting member by varying said predetermined tension based on said driving signal.

14. The vibration presentation apparatus according to claim 13, wherein said second driving mechanism comprises a flat spiral spring, a voice coil and a bobbin, said flat spiral spring is supported by said voice coil and said bobbin is connected to a shaft of said flat spiral spring, said transmitting member is connected to said bobbin and is wound or rewound on said bobbin, said flat spiral spring winds or rewinds said transmitting member via said bobbin, said transmitting member is towed and said predetermined tension is generated to said transmitting member, and said driving signal on a basis of said vibration presentation signal is inputted into said voice coil.

15. The vibration presentation apparatus according to claim 1, wherein said transmitting member comprises a material having a line-shape, a belt-shape or a net-shape, or a combination material thereof.

16. The vibration presentation apparatus according to claim 1, wherein said transmitting member comprises connection sections that are disposed at inward positions from one end and the other end of said transmitting member, and said connection sections connect or disconnect said transmitting member by means of connection members that constitute said connection sections.

17. The vibration presentation apparatus according to claim 16, wherein said connection members comprise a hook that is disposed near one end of said transmitting member, and a ring that is disposed near the other end of said transmitting member and is engaged with said hook.

18. The vibration presentation apparatus according to claim 1, wherein said transmitting member comprises a draw-in mechanism that said both ends of said transmitting member are drawn inwardly, and said draw-in mechanism, which alternates said driving mechanism or cooperates with said driving mechanism, generates said predetermined tension to said transmitting member by winding said transmitting member to an inside of said draw-in mechanism.

19. The vibration presentation apparatus according to claim 1, wherein said first holder is connected to said second holder each other.

20. A vibration presentation apparatus comprising a transmitting member and a control unit, wherein a side portion of said transmitting member is abutted to a portion of a vibration presentation object or is wound to said vibration presentation object, said transmitting member comprises a single holder to hold said both ends of said transmitting member, a driving mechanism that applies said tension to said transmitting member is provided with said holder, said driving mechanism comprises two bobbins and an electric motor, said two bobbins are connected to a rotational shaft of said electric motor, one end and the other end of said transmitting member are connected to said two bobbins from different directions to wind or rewind said transmitting member by means of a rotation of said electric motor, a driving signal on a basis of a vibration presentation signal is inputted into said electric motor, by driving said electric motor and winding or rewinding one end and the other end of said transmitting member on said two bobbins, said transmitting member is towed by means of said predetermined tension, and said vibration is transmitted to said vibration presentation object via said transmitting member by varying said predetermined tension based on said driving signal.

21. The vibration presentation apparatus according to claim 20, wherein said driving mechanism further includes another driving mechanism that is different from a driving mechanism that comprises said two bobbins and said electric motor, said another driving mechanism generates said predetermined tension, and a driving mechanism that comprises said two bobbins and said electric motor varies said predetermined tension based on said driving signal on a basis of said vibration presentation signal.

22. The vibration presentation apparatus according to claim 21, wherein said driving mechanism further includes another driving mechanism that is different from a driving mechanism that comprises said two bobbins and said electric motor, a driving mechanism that comprises said two bobbins and said electric motor generates said predetermined tension, and said another driving mechanism varies said predetermined tension based on said driving signal on a basis of said vibration presentation signal.

23. The vibration presentation apparatus according to claim 21, wherein said another driving mechanism comprises a driving component such as a motor, a flat spiral spring, a voice coil, a speaker, a spring, a coil spring, a piezoelectric material and an electrically conductive polymer actuator or a combination thereof, and a motive power transmitting component such as a bobbin, a pulley, a gear and a worm gear or a combination thereof.

24. A vibration presentation apparatus comprising a transmitting member and a control unit, wherein a side portion of said transmitting member is abutted to a portion of a vibration presentation object or is wound to said vibration presentation object, said transmitting member comprises a single holder to hold said both ends of said transmitting member, a driving mechanism that applies said tension to said transmitting member is provided with said holder, said driving mechanism comprises a flat spiral spring, a voice coil and a bobbin, said flat spiral spring is supported by said voice coil and said bobbin is connected to a shaft of said flat spiral spring, said transmitting member is connected to said bobbin and is wound or rewound on said bobbin, said flat spiral spring winds or rewinds said transmitting member via said bobbin, said transmitting member is towed and said predetermined tension is generated to said transmitting member, said driving signal on a basis of said vibration presentation signal is inputted into said voice coil, by driving said driving mechanism, said predetermined tension is varied based on said driving signal on a basis of said vibration presentation signal, and vibration is transmitted to said vibration presentation object via said transmitting member.

25. The vibration presentation apparatus according to claim 20, wherein said transmitting member comprises a material having a line-shape, a belt-shape or a net-shape, or a combination material thereof.

26. The vibration presentation apparatus according to claim 20, wherein said transmitting member comprises connection sections that are disposed at inward positions from one end and the other end of said transmitting member, and said connection sections connect or disconnect said transmitting member by means of connection members that constitute said connection sections.

27. The vibration presentation apparatus according to claim 26, wherein said connection members comprise a hook that is disposed near one end of said transmitting member, and a ring that is disposed near the other end of said transmitting member and is engaged with said hook.

28. The vibration presentation apparatus according to claim 20, wherein said transmitting member comprises a draw-in mechanism that said both ends of said transmitting member are drawn inwardly, and said draw-in mechanism, which alternates said driving mechanism or cooperates with said driving mechanism, generates said predetermined tension to said transmitting member by winding said transmitting member to an inside of said draw-in mechanism.

29. A method for using the vibration presentation apparatus according to claim 19 that said vibration presentation object is a user, comprising steps of:

coiling at least one turn of said transmitting member around a portion of said user body with clothes on;

connecting said first holder to said second holder at any positon of a portion of said user body; and driving said vibration presentation apparatus after said connecting, wherein said user feels said vibration based on said vibration presentation signal.

30. The method for using a vibration presentation apparatus according to claim 29, wherein said portion of said user body is a breast, a waist, a shoulder or a diagonal portion from a shoulder to a waist, or a combination thereof.

31. The method for using a vibration presentation apparatus according to claim 29, wherein a position that is connected said first holder to said second holder is a front side of said user.

32. A method for using the vibration presentation apparatus according to claim 20 that said vibration presentation object is a user, comprising steps of:

coiling at least one turn of said transmitting member around a portion of said user body with clothes on; and driving said vibration presentation apparatus after said coiling, wherein said user feels said vibration based on said vibration presentation signal.

* * * * *